US009788593B2

(12) United States Patent
Lebel et al.

(10) Patent No.: US 9,788,593 B2
(45) Date of Patent: Oct. 17, 2017

(54) MANDIBLE GUARD ADJUSTMENT SYSTEM

(71) Applicant: Revision Military S.a.r.L., Luxembourg (LU)

(72) Inventors: Stéphane Lebel, St. Redempteur (CA); Dominic Giroux Bernier, Montreal (CA); Richard Coomber, Montreal (CA)

(73) Assignee: Revision Military S.a.r.L., Luxembourg (LU)

( * ) Notice: Subject to any disclaimer, the term of this patent is extended or adjusted under 35 U.S.C. 154(b) by 875 days.

(21) Appl. No.: 14/083,387

(22) Filed: Nov. 18, 2013

(65) Prior Publication Data

US 2015/0135417 A1 May 21, 2015

(51) Int. Cl.

| | |
|---|---|
| ***A42B 3/08*** | (2006.01) |
| ***A42B 3/32*** | (2006.01) |
| ***A42B 3/22*** | (2006.01) |

(52) U.S. Cl.

CPC ..... *A42B 3/326* (2013.01); *A42B 3/222* (2013.01)

(58) Field of Classification Search

CPC ..... A42B 3/326; A42B 3/222

See application file for complete search history.

(56) References Cited

U.S. PATENT DOCUMENTS

| | | | | |
|---|---|---|---|---|
| 2,908,911 A | | 10/1959 | Sowle | |
| 3,216,023 A | * | 11/1965 | Morgan | A42B 3/08 128/857 |
| 3,293,660 A | | 12/1966 | Lance | |
| 3,478,365 A | * | 11/1969 | Tibor | A42B 3/08 2/424 |
| 3,897,598 A | | 8/1975 | Bednarczuk et al. | |
| 4,042,974 A | | 8/1977 | Morgan et al. | |
| 4,689,836 A | * | 9/1987 | Vitaloni | A42B 3/326 2/411 |
| 4,766,615 A | * | 8/1988 | Morin | A42B 3/326 2/410 |
| 4,769,857 A | * | 9/1988 | Cianfanelli | A42B 3/326 2/421 |
| 4,885,806 A | * | 12/1989 | Heller | A42B 3/326 2/423 |
| 5,093,939 A | | 3/1992 | Noyerie et al. | |
| 5,129,108 A | | 7/1992 | Copeland et al. | |

(Continued)

FOREIGN PATENT DOCUMENTS

| | | |
|---|---|---|
| FR | 2 595 920 A1 | 9/1987 |
| FR | 2 876 005 A1 | 4/2006 |

(Continued)

OTHER PUBLICATIONS

U.S. Appl. No. 13/563,613, filed Jul. 31, 2012, McGinn et al.

(Continued)

*Primary Examiner* — Richale Quinn

(74) *Attorney, Agent, or Firm* — Wolf, Greenfield & Sacks, P.C.

(57) ABSTRACT

Methods and devices for adjusting the position of a mandible guard relative to a helmet are disclosed. Adjustment of the mandible guard may be performed by a user while the user is wearing the helmet and/or without the use of tools. A mandible guard adjustment system may be combined with an attachment system for attaching and removing the mandible guard to a helmet.

41 Claims, 15 Drawing Sheets

(56) References Cited

U.S. PATENT DOCUMENTS

| | | | | |
|---|---|---|---|---|
| 5,146,245 | A | 9/1992 | Bolinger | |
| 5,263,204 | A | 11/1993 | Butsch | |
| 5,384,914 | A | 1/1995 | Caveness et al. | |
| 5,412,814 | A | 5/1995 | Pernicka et al. | |
| 5,483,699 | A | 1/1996 | Pernicka et al. | |
| 6,125,477 | A * | 10/2000 | Crippa | A42B 3/222 2/10 |
| 6,226,803 | B1 * | 5/2001 | Tanaka | A42B 3/326 2/424 |
| 6,237,161 | B1 * | 5/2001 | Lee | A42B 3/326 2/414 |
| 6,247,811 | B1 | 6/2001 | Rhoades et al. | |
| 6,606,751 | B1 * | 8/2003 | Kalhok | A42B 3/226 2/424 |
| 6,834,398 | B1 | 12/2004 | Martinez | |
| 6,892,400 | B1 * | 5/2005 | Choi | A42B 3/326 2/424 |
| 7,024,704 | B2 * | 4/2006 | Gafforio | A42B 3/326 2/424 |
| 7,398,561 | B2 * | 7/2008 | Kim | A42B 3/326 2/424 |
| 7,555,788 | B2 * | 7/2009 | Schimpf | A42B 3/326 2/410 |
| 7,814,579 | B2 * | 10/2010 | Dion | A42B 3/222 2/410 |
| 7,900,268 | B2 | 3/2011 | Mahan | |
| 8,011,025 | B2 * | 9/2011 | Lee | A42B 3/326 2/15 |
| 8,082,600 | B2 * | 12/2011 | Morin | A42B 3/222 2/15 |
| 2002/0129440 | A1 * | 9/2002 | Hong | A42B 3/326 2/422 |
| 2003/0182716 | A1 * | 10/2003 | Wu | A42B 3/326 2/424 |
| 2005/0015861 | A1 * | 1/2005 | Gafforio | A42B 3/326 2/424 |
| 2006/0064799 | A1 * | 3/2006 | Dion | A42B 3/326 2/424 |
| 2007/0083967 | A1 | 4/2007 | Crossman et al. | |
| 2007/0136934 | A1 * | 6/2007 | Kim | A42B 3/222 2/424 |
| 2008/0092278 | A1 | 4/2008 | Rogers et al. | |
| 2008/0196148 | A1 * | 8/2008 | Morin | A42B 3/326 2/421 |
| 2008/0216215 | A1 * | 9/2008 | Lee | A42B 3/326 2/424 |
| 2008/0289085 | A1 | 11/2008 | Bryant et al. | |
| 2010/0132095 | A1 | 6/2010 | Gafforio et al. | |
| 2011/0113519 | A1 | 5/2011 | Gendron et al. | |
| 2011/0113535 | A1 | 5/2011 | Lebel et al. | |
| 2011/0302701 | A1 * | 12/2011 | Kuo | A42B 3/326 2/421 |
| 2011/0314594 | A1 | 12/2011 | Rogers et al. | |
| 2012/0117717 | A1 | 5/2012 | McGinn et al. | |
| 2012/0222199 | A1 | 9/2012 | Tatomir | |
| 2014/0033406 | A1 * | 2/2014 | Lebel | A42B 3/04 2/422 |
| 2014/0075654 | A1 | 3/2014 | McGinn et al. | |
| 2015/0026858 | A1 | 1/2015 | Ross et al. | |
| 2015/0033457 | A1 | 2/2015 | Tryner et al. | |

FOREIGN PATENT DOCUMENTS

| | | | |
|---|---|---|---|
| FR | 2 876 882 | A1 | 4/2006 |
| WO | WO 2014/020441 | A2 | 2/2014 |

OTHER PUBLICATIONS

International Search Report and Written Opinion for PCT/IB2014/003022 dated Jun. 12, 2015.

PCT/IB2014/003022, dated Jun. 12, 2015, International Search Report and Written Opinion.

* cited by examiner

MANDIBLE GUARD ADJUSTMENT SYSTEM

FIELD

Aspects herein relate to arrangements and methods for adjusting a mandible guard relative to a helmet.

DISCUSSION OF RELATED ART

Many helmets include a mandible guard that is attachable to or integrally formed with the helmet.

SUMMARY

According to one embodiment, an apparatus includes a mandible guard for a helmet and a position control that holds the mandible guard in a first position relative to the helmet and a second position relative to the helmet. The first position defines a first distance from a point on the helmet to a point on the mandible guard and the second position defines a second distance from the point on the helmet to the point on the mandible guard. The second distance is different from the first distance. The point on the helmet is a laterally centered point on a front brim of the helmet, and the point on the mandible guard is a laterally centered point on the mandible guard. The position control permits adjustment of the mandible guard from the first position to the second position by a user while the helmet is worn by the user. In the first and second positions, the mandible guard is below the front brim of the helmet.

According to another embodiment, an apparatus includes a mandible guard, an attachment arm configured to attach the mandible guard to a helmet, and a position control that holds the mandible guard in a first position relative to the attachment arm and a second position relative to the attachment arm. The mandible guard is movable relative to the attachment arm. The first position defines a first distance from a point on the helmet to a point on the mandible guard and the second position defines a second distance from the point on the helmet to the point on the mandible guard. The second distance is different from the first distance. The point on the helmet is a laterally centered point on a front brim of the helmet, and the point on the mandible guard is a laterally centered point on the mandible guard. In the first and second positions, the mandible guard is below the front brim of the helmet.

According to a further embodiment, an apparatus includes a mandible guard for a helmet and a position control that holds the mandible guard in a first position having a first pitch angle relative to the helmet and a second position having a second pitch angle relative to the helmet. The second pitch angle is different from the first pitch angle. The position control permits adjustment of the mandible guard from the first position to the second position by a user while the helmet is worn by the user. In the first and second positions, the mandible guard is below the front brim of the helmet.

According to a further embodiment, a method includes providing a mandible guard for a helmet and pivoting the mandible guard from a first position to a second position while the helmet is worn by a user. The second position is different from the first position. In the first and second positions, the mandible guard is below a front brim of the helmet.

According to another embodiment, an apparatus includes a mandible guard for a helmet and a position control that holds the mandible guard in a first position relative to the helmet and a second position relative to the helmet. The first position defines a first distance from a point on the helmet to a point on the mandible guard and the second position defines a second distance from the point on the helmet to the point on the mandible guard, the second distance being different from the first distance. The point on the helmet is a laterally centered point on a front brim of the helmet, and the point on the mandible guard is a laterally centered point on the mandible guard. In the first and second positions, the mandible guard is below the front brim of the helmet. The position control permits adjustment of the mandible guard from the first position to the second position without the use of a tool.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
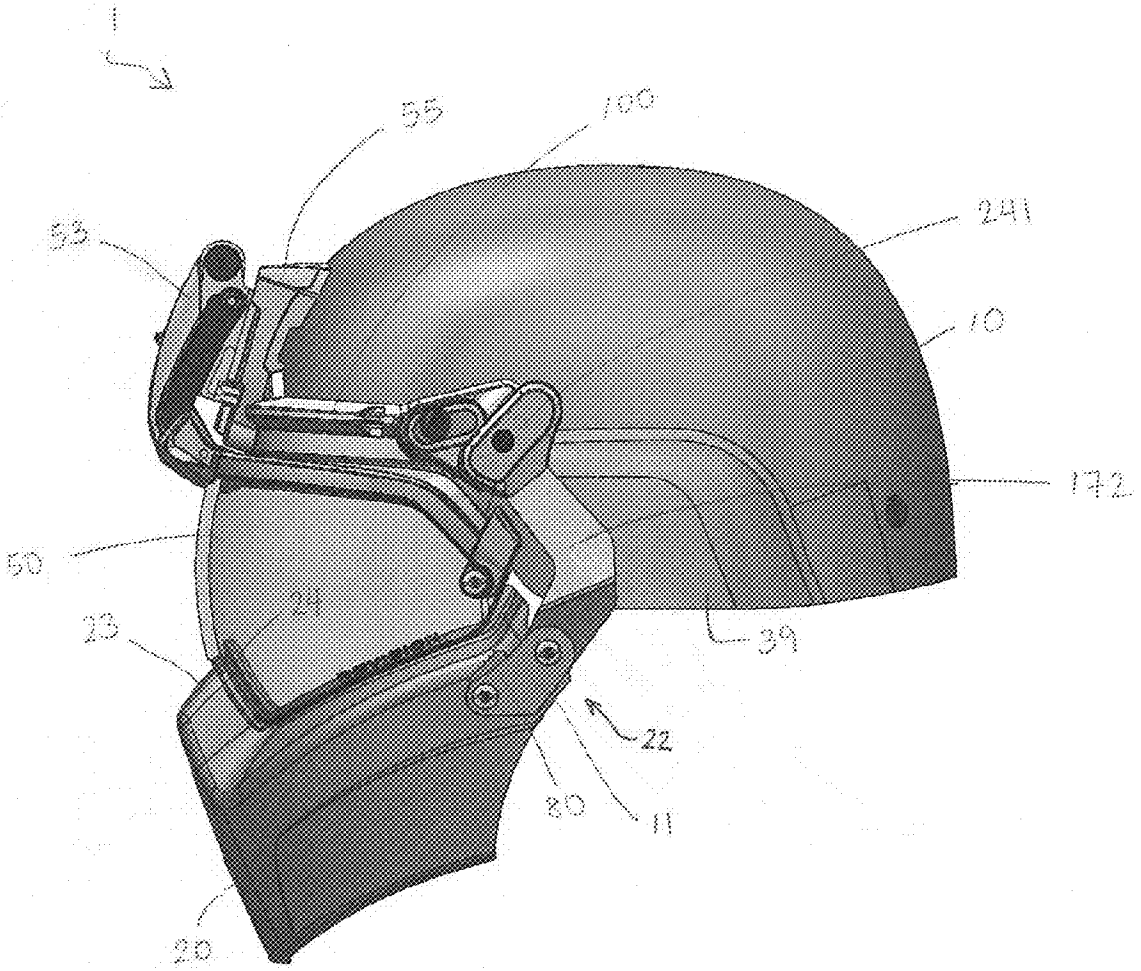
FIG. 1 is a side view of a helmet assembly outfitted with an embodiment of a mandible guard adjustment system and a mandible guard attachment system in accordance with an aspect of the invention.

Helmets for head protection and safety often include a mandible guard to provide protection for at least a portion of the jaw. As used herein, a "mandible guard" is a rigid structure that protects at least a portion of a wearer's jaw.

Some helmets have a mandible guard that is integrally formed with the helmet as a single monolithic structure. Such mandible guards are permanently fixed to the helmet and cannot be removed, and the position of these mandible guards relative to the helmet cannot be adjusted. Other helmets have mandible guards that can be detached from the helmet using tools such as a screwdriver or a hex key.

Aspects herein provide a helmet arrangement that permits a user to adjust the position of a mandible guard relative to the helmet. Applicants have appreciated that such an arrangement may provide convenient and efficient adjustment of the mandible guard without requiring removal of the helmet, which may ease communication, ventilation, and hydration while wearing the helmet. Applicants have also appreciated that a helmet having a removable and/or adjustable mandible guard can have structural vulnerabilities at connection points between the helmet and the mandible guard. As such, Applicants have developed arrangements that enable quick and convenient adjustability and/or detachment of the mandible guard, while still providing effective protection to the user.

According to one aspect, the helmet arrangement includes a mandible guard adjustment system that permits the mandible guard to be adjustable between several positions relative to the helmet without removing the mandible guard from the helmet. In some embodiments, the entire mandible guard may be adjustable between the several positions relative to the helmet. As used herein, adjusting the position of the mandible guard relative to the helmet includes angular and/or translational displacement of the mandible guard relative to the helmet. The mandible guard adjustment system may hold the mandible guard in various positions relative to the helmet. As used herein, when the mandible guard adjustment system "holds the mandible guard" in a position, the mandible guard remains in the position without being held by the user. As used herein, when the mandible guard adjustment system "secures the mandible guard" in a position, the mandible guard is prevented from movement in at least one direction unless a release mechanism or other release element is actuated. For example, in the intermediate position, the mandible guard may be prevented from rotating downwardly unless a release mechanism is actuated, but free to rotate upwardly simply by pushing upwardly on the mandible guard. As used herein, when the mandible guard adjustment system "fully secures the mandible guard in a position," the mandible guard is prevented from movement in both directions unless a release mechanism or other release element is actuated. In some embodiments, in each of its different positions, the mandible guard remains below the front brim of the helmet. As used herein, the "front brim" of the helmet is the portion of the helmet brim at the front of the helmet that is at a position higher than the level of the user's eyes when the user wears the helmet.

FIG. 1 illustrates an embodiment of a helmet assembly 1 incorporating one embodiment of a mandible guard adjustment system 22. The helmet assembly 1 includes a helmet 10 and a mandible guard 20 that is adjustable relative to the helmet 10 via a mandible guard adjustment system 22, which is described in detail below. It should be appreciated that the helmet may be used for military, law enforcement, motorcycle, or any other suitable application, as this aspect is not so limited.

The mandible guard 20 is also removably attachable to the helmet 10 via a mandible guard attachment system in some embodiments, which is described in detail below. As used herein, "attached" is not limited to directly attached; two components may be attached to one another via intervening components. As such, as shown in FIG. 1, the mandible guard 20 is attached to the helmet 10 via an attachment arm 172. Although the mandible guard does not directly attach to the helmet, the mandible guard is still considered to be attached to the helmet.

In some embodiments, a protective face shield, such as a transparent visor 50, is operatively connected to the helmet substantially between a front rim of the helmet and the mandible guard. The face shield may be mounted to the helmet using any suitable mounting arrangement including central accessory mount 55 and mounting arrangement 53 as described in U.S. Pat. App. Publ. No. 2012/0117717, which application is herein incorporated by reference to the extent not inconsistent with the present description. Alternatively, the protective face shield may be mounted to the helmet via the currently disclosed mandible guard attachment system. In some embodiments, the mandible guard may be any suitable construction disclosed in U.S. Pat. App. Publ. No. 2012/0117717. The mandible guard has a top surface 23. In some embodiments, the top surface 23 of the mandible guard may include an upstanding rim 24 that provides a surface against which a face shield 50 may abut.

Figure 2A:
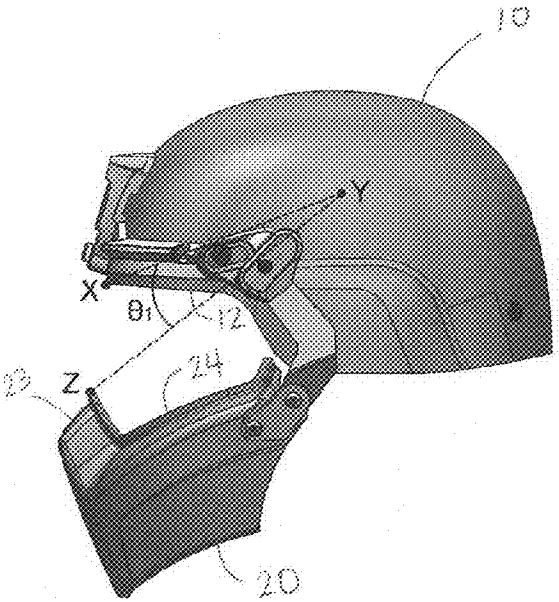
FIG. 2A depicts the helmet assembly of FIG. 1 with the mandible guard in the fully raised position.
Figure 2B:
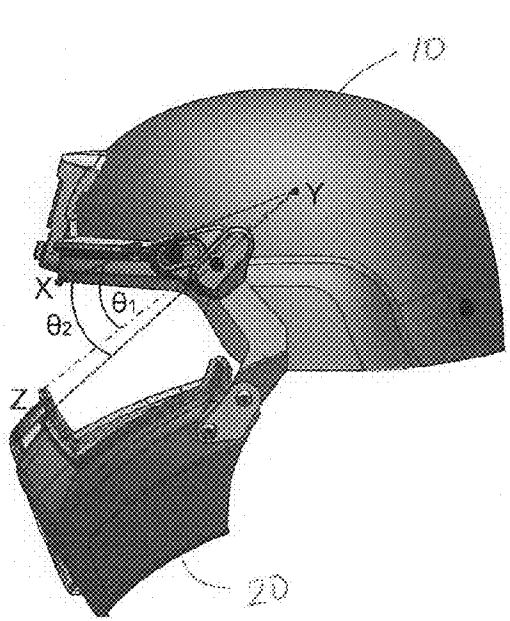
FIG. 2B depicts the helmet assembly of FIG. 1 with the mandible guard being moved from the fully raised position to the intermediate position.
Figure 2C:
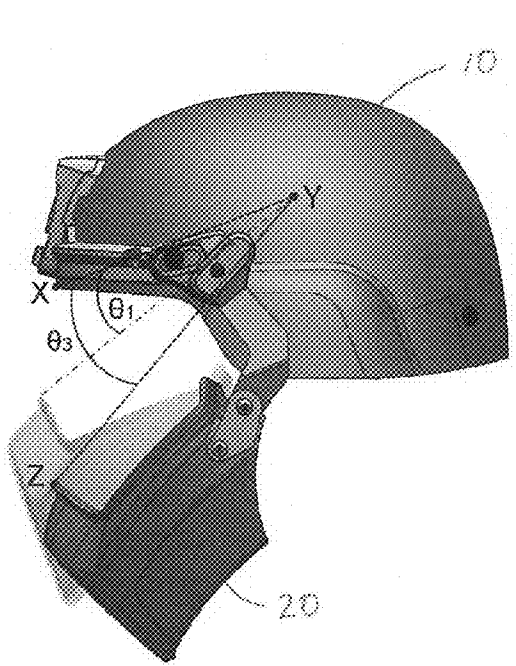
FIG. 2C depicts the helmet assembly of FIG. 1 with the mandible guard being moved from the fully raised position to the fully lowered position.

The mandible guard adjustment system 22 permits the mandible guard to be adjusted between several different positions relative to the helmet, and in some embodiments, holds the mandible guard at these different positions. These positions may be discrete positions that are spaced apart from one another, or they may be a continuous spectrum of positions that are not spaced from one another. As shown in FIGS. 2A-2C, in some embodiments, the mandible guard 20 may be adjusted between three discrete, spaced positions: fully raised as shown in FIG. 2A; the intermediate position as shown in FIG. 2B; and fully lowered as shown in FIG. 2C. In each position, the distance between reference point X on the front brim 12 of the helmet and reference point Z on the mandible guard 20 is different from other positions.

Figure 2D:
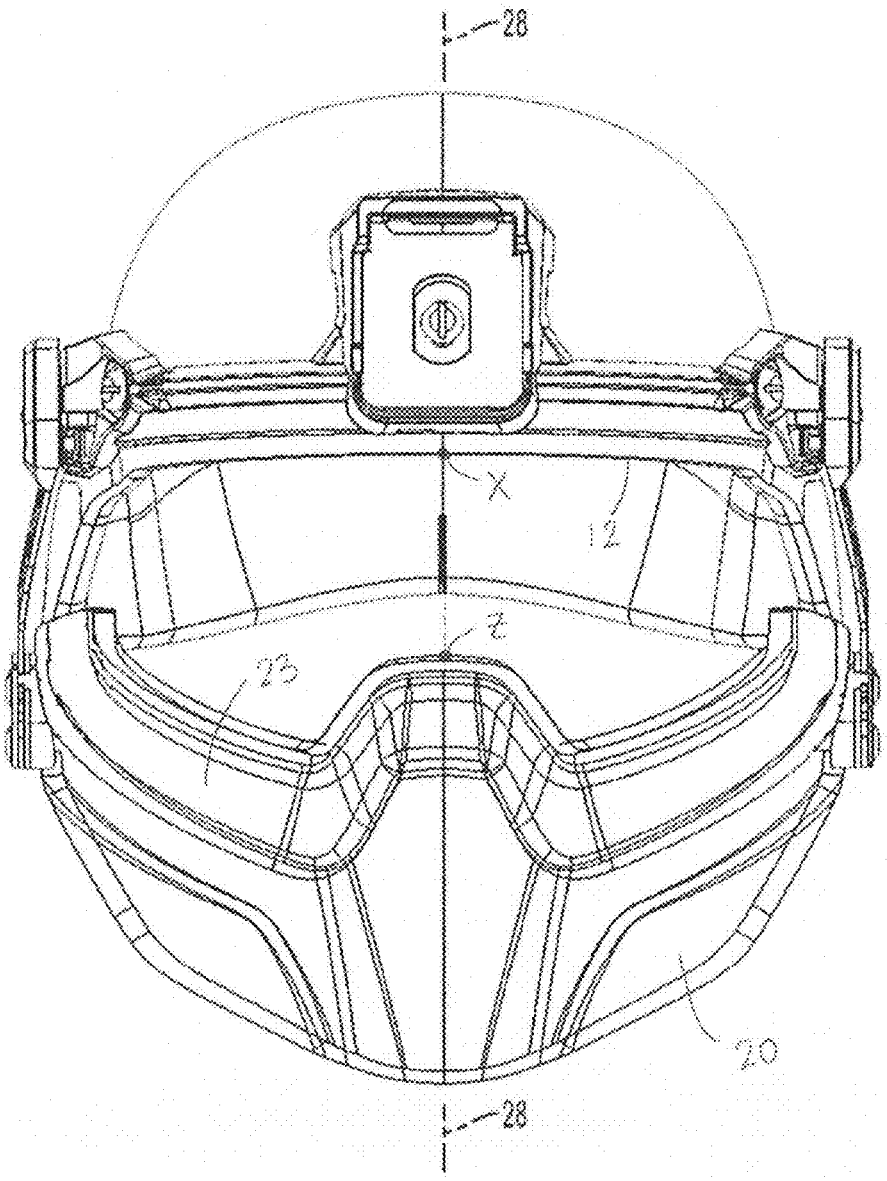
FIG. 2D is a front view of a helmet for purposes of illustrating a laterally central axis and reference points on the front brim of the helmet and mandible guard.

FIG. 2D is a front view of a helmet for purposes of illustrating a laterally central axis and reference points on the front brim of the helmet and the mandible guard. As shown in FIG. 2D, point X is a laterally centered point on the front brim 12 of a helmet, and point Z is a laterally centered point on the mandible guard 20. As used herein, a "laterally centered point" on an object is a point on the object that is equidistant between the two sides of an object. As seen in FIG. 2D, center plane 28 is a vertical, front-to-back center plane that vertically bisects a helmet assembly. The intersection of the front brim of the helmet with center plane 28 defines all possible laterally centered points on a front brim of the helmet. Similarly, intersection of the mandible guard with center plane 28 defines all possible laterally centered points on a mandible guard. In this case, Z is chosen to be located on the upstanding rim 24 of the mandible guard, but it should be appreciated that point Z can be anywhere on the mandible guard that intersects with center plane 28. For example, point Z can be located on the top surface 23 of the mandible guard anywhere along center plane 28, or on a lower portion of the mandible guard along center plane 28. In addition, it should be appreciated that point X can be located on anywhere on the front brim 12 of the helmet along center plane 28. The distance between reference points X and Z increases as the mandible guard is moved from the fully raised position to the intermediate position to the fully lowered position.

In some embodiments, the mandible guard adjustment system 22 holds the mandible guard at different positions relative to the helmet, where in each position, the mandible guard remains below the front brim 12 of the helmet.

In some embodiments, as shown in FIGS. 2A-2D, in each position, the mandible guard 20 is also at a different pitch angle relative to the helmet. As used herein, the pitch angle of the mandible guard relative to the helmet is defined by the angle formed by a first line between a laterally centered point on the front brim of the helmet (e.g., point X) to a point on the helmet (e.g., point Y) and a second line between the same point on the helmet (e.g., point Y) and a laterally centered point on the mandible guard (e.g., point Z). Point Y is any point on the helmet other than the point already chosen for point X.

In the fully raised position shown in FIG. 2A, the mandible guard is at a pitch angle $\theta_1$ relative to the helmet. In the intermediate position shown in FIG. 2B, the mandible guard is at a pitch angle $\theta_2$ that is greater than the pitch angle $\theta_1$ from the fully raised position, and in the fully lowered position shown in FIG. 2C, the mandible guard is at a pitch angle $\theta_3$ that is greater than the pitch angles $\theta_1$ and $\theta_2$ from the fully raised and intermediate positions, respectively. In some embodiments, in the intermediate position, the mandible guard is at a pitch angle that is at least five degrees greater than when in the fully raised position. In the intermediate position, the mandible guard may be at a pitch angle that is 1 to 16 degrees, 3 to 13 degrees, 5 to 11 degrees, 6 to 10 degrees, 7 to 9 degrees, 8 degrees, or any suitable number of degrees greater than when in the fully raised position. In the fully lowered position, the mandible guard may be at a pitch angle that is 11 to 40 degrees, 15 to 35 degrees, 20 to 30 degrees, 22 to 28 degrees, 23 to 27 degrees, 24 to 26 degrees, 25 degrees, or any suitable number of degrees greater than when in the fully raised position.

As shown in FIG. 2A-2C, for each of the available positions for the mandible guard, the mandible guard remains below the front brim 12 of the helmet. Of course, it should be appreciated that any suitable number of discrete positions may be used and may be at different pitch angles than that shown in FIGS. 2A-2C. In some embodiments, the mandible guard adjustment system may hold the mandible guard at a continuous spectrum of pitch angles rather than discrete pitch angles that are spaced apart from one another.

Figure 3B:
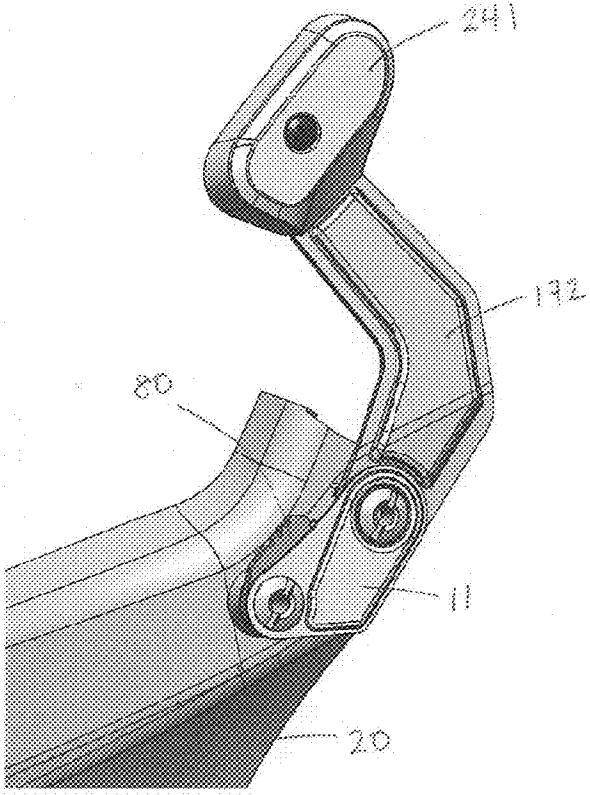
FIG. 3B is a perspective view of the mandible guard adjustment system.
Figure 3A:
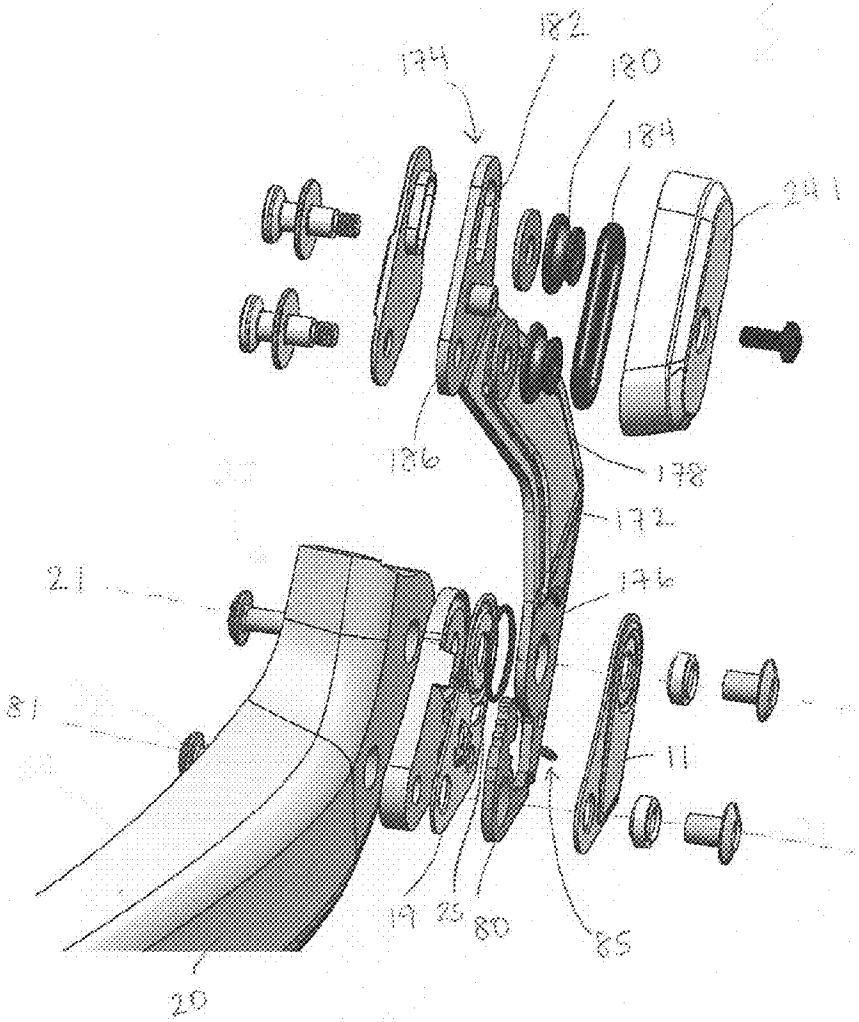
FIG. 3A is an exploded view of the mandible guard adjustment system.

In some embodiments, the available pitch angles of each position are set by the arrangement of a mandible guard adjustment system. FIGS. 3A-3B depict one embodiment of a mandible guard adjustment system 22 which includes a position control 80 and an attachment arm 172. The attachment arm 172 has an attachment portion 174, and an accessory retention portion 176. The attachment arm also attaches to a body upper portion 241. In some embodiments, the attachment arm is integrally formed with the body upper portion 241. As used herein, a "position control" may include any component that holds and/or secures the mandible guard in one or more positions, and/or may include any release mechanism that permits unlocking of the mandible guard from one or more positions. In some embodiments, where one or more release mechanisms are not used, the position control includes only components that hold and/or secure the mandible guard in one or more positions. A position control may include one or more components. In some embodiments, the position control includes physically separate components.

Figures 4A, 4B, 4C:
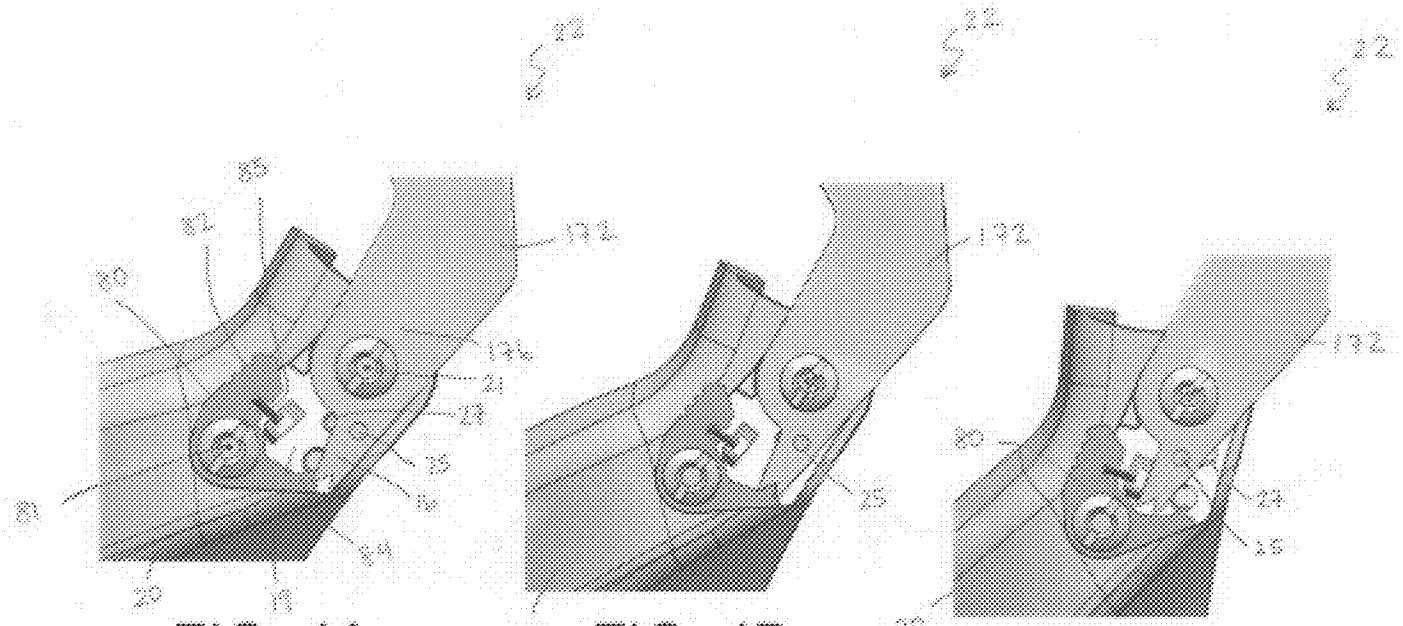
FIG. 4A is a cutaway view of the mandible guard adjustment system where the mandible guard is in the fully raised position, as shown in FIG. 2A.
FIG. 4B depicts a cutaway view of the mandible guard adjustment system where the mandible guard is in the intermediate position, as shown in FIG. 2B.
FIG. 4C is a cutaway view of the mandible guard adjustment system where the mandible guard is in the fully lowered position, as shown in FIG. 2C.
Figure 4E:
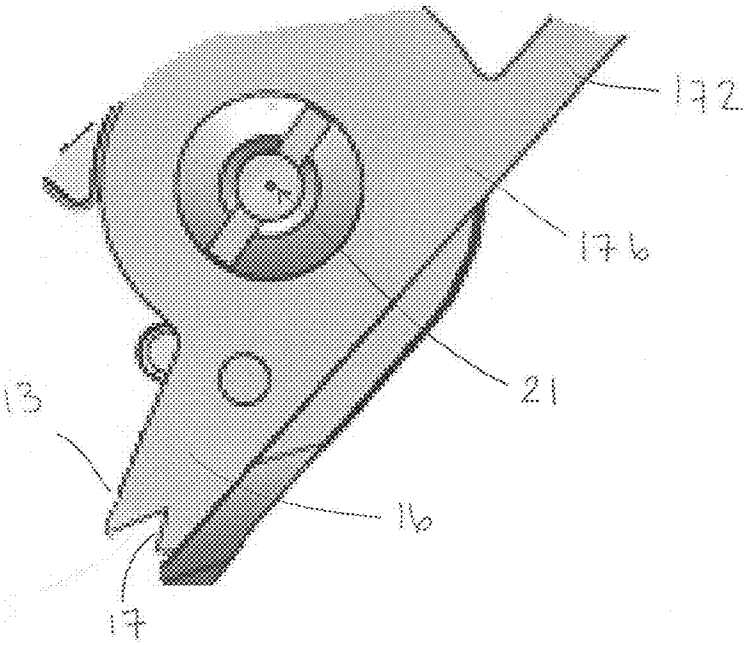
FIG. 4E is an enlarged view of an end of an attachment arm shown in FIG. 4A.
Figure 4D:
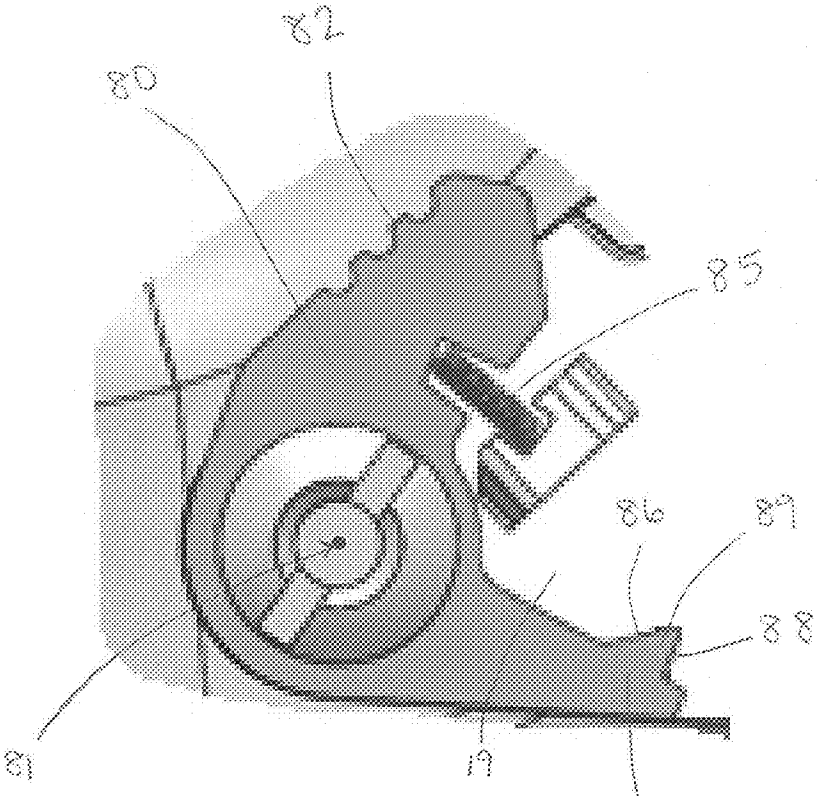
FIG. 4D is an enlarged view of a position control shown in FIG. 4A.

In some embodiments, the mandible guard adjustment system functions as a ratchet and pawl type mechanism. In one embodiment, as seen in FIG. 4A, the position control 80 includes a pawl 84 and a pawl release mechanism 82, and an attachment arm end 16 includes teeth that interact with the pawl 84. As shown in FIG. 4D, the pawl 84 has a protrusion 89 with a gently sloped surface 86 and a steeply sloped surface 88. As can be seen in FIG. 4E, the attachment arm end 16 has teeth 13 and 17. Abutment of the pawl 84 with tooth 13 holds the mandible guard 20 in the fully raised position shown in FIG. 4A, and abutment of the pawl 84 with tooth 17 holds the mandible guard 20 in the intermediate position as shown in FIG. 4B. As will be discussed below, abutment of pin 25 on the attachment arm 172 with the left end of slot 27 on inner plate 19 holds the mandible guard in the fully lowered position as shown in FIG. 4C.

In the fully raised and intermediate positions, shown in FIGS. 4A and 4B, the interaction of the pawl 84 with the teeth 13, 17 locks the mandible guard 20 from rotating downward relative to the attachment arm 172. Thus, if a force is applied to the mandible guard 20 in the downward direction, the mandible guard 20 is prohibited from downward movement due to interaction between pawl 84 with the teeth 13, 17. Actuation of the pawl release mechanism 82 rotates the pawl 84 away from teeth 13 and 17, which unlocks the mandible guard and allows the user to move the mandible guard downward relative to attachment arm 172 and the helmet. When the mandible guard 20 is released from its locked state, the mandible guard can pivot relative to the attachment arm 172 about an axis 21 (see FIG. 3A).

Because attachment arm 172 is fixed to the helmet, the mandible guard 20 also pivots relative to the helmet 10 about axis 21 when the mandible guard 20 is released from its locked state. The position control 80 is pivotally mounted to the mandible guard 20 about an axis 81. A portion of the position control is sandwiched between an outer plate 11 and an inner plate 19, which are both fixed to the mandible guard 20. Thus, the position control 80 also pivots relative to the plates 11, 19 about axis 81.

The details of the mandible guard adjustment system 22 are further depicted in FIGS. 4A-4E, in which the outer plate 11 has been removed for illustrative purposes. FIGS. 4A, 4B and 4C correspond with FIGS. 2A, 2B and 2C, respectively. Accordingly, FIG. 4A depicts the mandible guard adjustment system when the mandible guard is in the fully raised position, FIG. 4B depicts the mandible guard adjustment system when the mandible guard is in the intermediate position, and FIG. 4C depicts the mandible guard adjustment system when the mandible guard is in the fully lowered position. The locations and angles of the surfaces on the pawl 84 and the attachment arm teeth 13, 17 determine the available angles into which the mandible guard can be moved. For example, the leading edge of tooth 13 defines the pitch angle of the fully raised position shown in FIG. 2A, and the leading edge of tooth 17 defines the pitch angle of the intermediate position shown in FIG. 2B. In the fully raised position depicted by FIG. 4A, the steeply sloped surface 88 of the pawl 84 abuts against the first tooth 13 of the attachment arm end 16. This abutment between the surface 88 and tooth 13 prevents the mandible guard 20 from rotating downwardly, and thus the mandible guard 20 is locked in the fully raised position.

To allow angular adjustment, in some embodiments, position control 80 has a pawl release mechanism 82 and is pivotally mounted to the mandible guard 20 by about an axis 81. The user actuates the position control 80 by pushing on pawl release mechanism 82, which causes the position control 80 to pivot relative to attachment arm 172 and inner plate 19 in a clockwise direction. As a result, the pawl 84 is pivoted away from teeth 13, 17. The surface 88 of the position control 80 is free to move downwardly past the first tooth 13 of the attachment arm 172, and thus the mandible guard 20 is also free to move downwardly. The mandible guard 20 may move downwardly by application of a force or by gravity.

Position control 80 is biased towards the counter-clockwise direction in the view illustrated in FIGS. 4A-4D by a biasing element such as a spring 85. The spring 85 abuts against the position control 80 at one end and the inner plate 19 at the other end. When the user stops pressing on the pawl release mechanism 82, position control 80 rotates back in the counter-clockwise direction due to the spring bias. As a result, when the mandible guard is moved to the intermediate position and the user stops pressing on the pawl release mechanism 82, the protrusion 89 of the position control 80 settles between teeth 13 and 17 of the attachment arm end 16, as shown in FIG. 4B.

In the intermediate position shown in FIG. 4B, the mandible guard 20 is rotated slightly downwardly relative to the attachment arm 172 and the helmet, and therefore the mandible guard is oriented at a greater pitch angle than that of the fully raised position. Pressing on the position control 80 again causes the pawl 84 to pivot away from teeth 13, 17, which permits the surface 88 of the position control 80 to move downwardly past the second tooth 17 of the attachment arm 172 until the pawl 84 of the position control 80 clears the end 16 of the attachment arm 172, as seen in FIG. 4C.

In the position shown in FIG. 4C, the mandible guard 20 is in the completely open, fully lowered position relative to the attachment arm 172 and the helmet. In the fully lowered position, the mandible guard is at a pitch angle that is greater than those of the fully raised and intermediate positions. In some embodiments, a user can actuate the pawl release mechanism 82 by hand, with a single finger, or otherwise, without the use of a tool. In this manner, the position of the mandible guard may be adjustable without the use of a tool in some embodiments. In other embodiments, however, the user may use a tool to actuate the pawl release mechanism or to otherwise adjust the position of the mandible guard.

It should be appreciated that the position control can include multiple components that hold and/or secure the mandible guard in one or more positions. In some embodiments, the position control may comprise a pawl and a pawl release mechanism that are physically separate components. In one embodiment, in addition to the aforementioned pawl and pawl release mechanism, the position control also includes a slot 27 and pin 25 arrangement. As shown in FIG. 4A, the inner plate 19 includes a slot 27 within which a pin 25 on the attachment arm 172 slides. When the mandible guard is at the fully raised position in FIG. 4A, the pin 25 abuts against the far right end of the slot 27, which secures the mandible guard from further movement of the mandible guard 20 in the upward direction. As the mandible guard 20 moves relative to the adjustment arm 172, the pin 25 travels along the slot 27. When the mandible guard reaches the fully lowered position in FIG. 4C, the pin 25 abuts against the far left end of the slot 27, which secures the mandible guard from further movement of the mandible guard 20 in the downward direction.

Figure 5C:
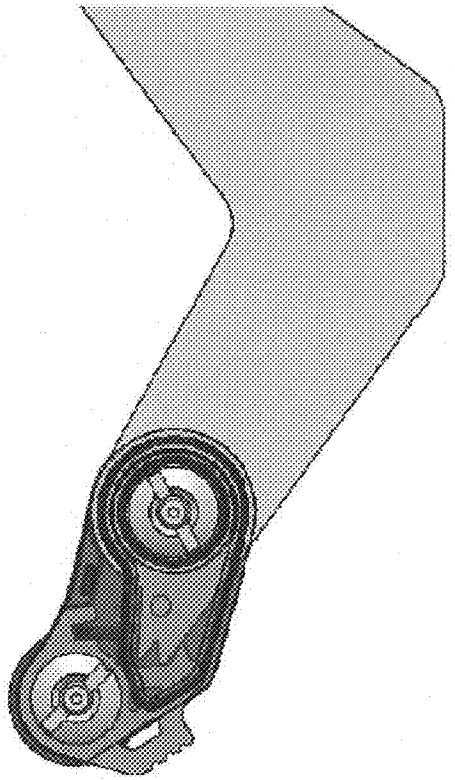
FIG. 5C is a cutaway view of the mandible guard adjustment system of FIG. 5A where the mandible guard is in the fully lowered position.
Figure 5B:
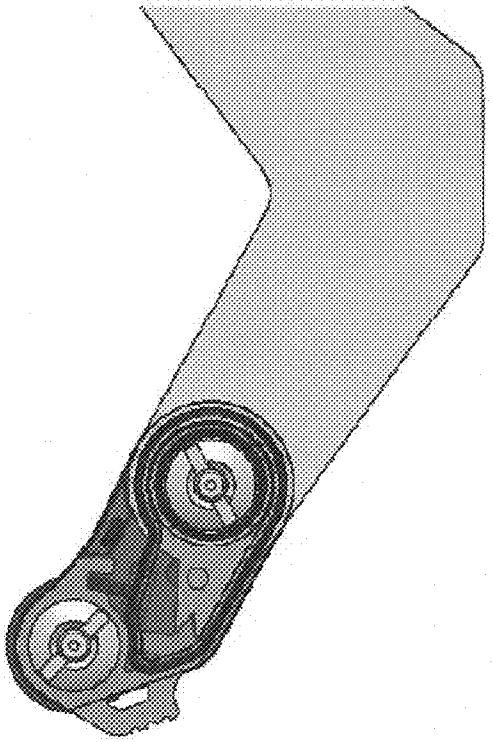
FIG. 5B depicts a cutaway view of the mandible guard adjustment system of FIG. 5A where the mandible guard is in the intermediate position.
Figure 5A:
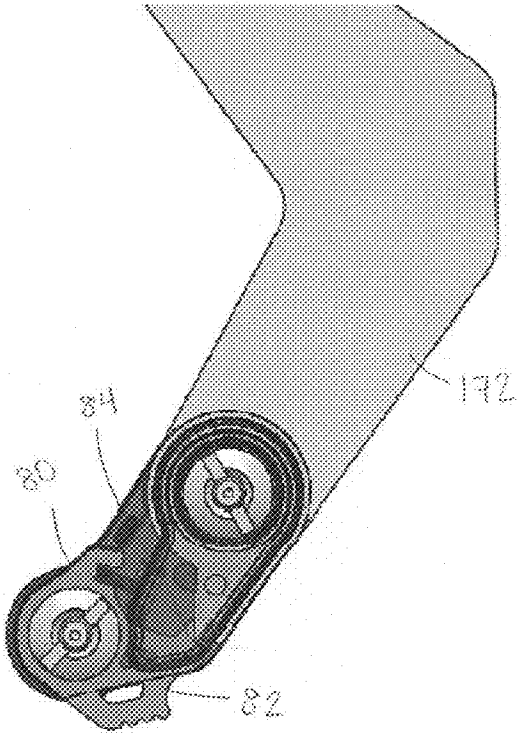
FIG. 5A is a cutaway view of another embodiment of a mandible guard adjustment system where the mandible guard is in the fully raised position.
Figure 6:
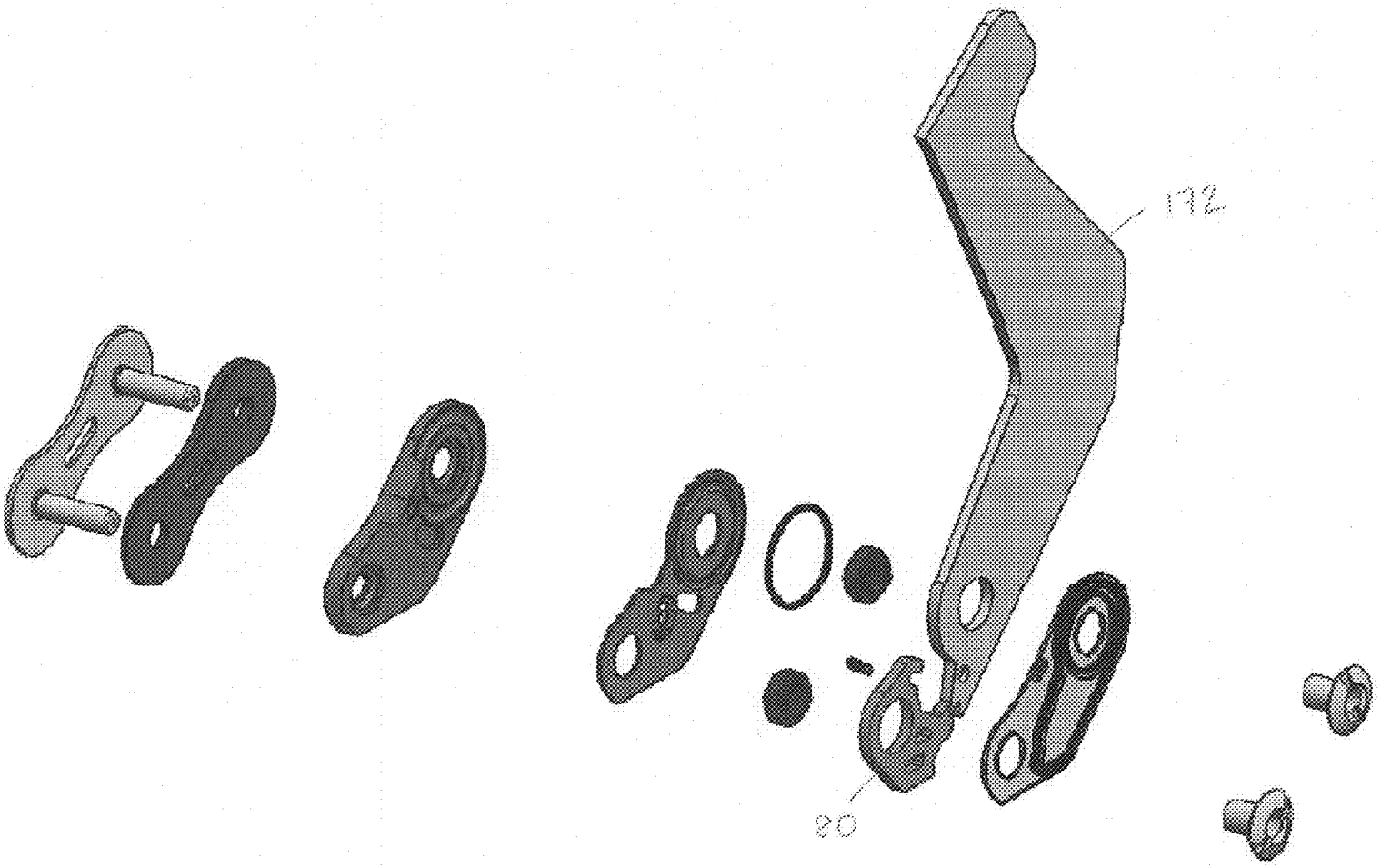
FIG. 6 is an exploded view of the mandible guard adjustment system of FIG. 5A.

It should be appreciated that the pawl release mechanism may be located at other locations other than that shown in the FIGS. 4A-4C. For example, in one alternative embodiment shown in FIGS. 5-6, pawl release mechanism 82 is located at a different location on the position control 80. To actuate the pawl release mechanism, a user pushes on the arcuate portion 82 to pivot the pawl 84 clockwise away from the teeth on the attachment arm 172. It should also be appreciated that the pawl release mechanism and the pawl need not be combined into a single component. In some embodiments, the pawl release mechanism may be a physically separate component from the pawl.

A single position control is described above, and a mandible guard system may include only a single position control in some embodiments. Two or more position controls may be provided in some embodiments. For example, a position control may be provided on both the left side of a helmet and on the right side of a helmet. In such an embodiment, a user may actuate release mechanisms simultaneously to adjust the angle of the mandible guard.

It should be appreciated that although the figures depict only three adjustable positions for the mandible guard, any number of suitable positions may be used, as this aspect is not so limited. The attachment arm end may have more than two teeth, where a greater number of teeth creates a greater number of adjustable positions. Some embodiments may have a greater number of adjustable positions to allow the user to fine-tune the angle and position of the mandible guard. In other embodiments, the mandible guard may have only two discrete positions, e.g., fully raised and fully lowered. In some embodiments, the mandible guard adjustment system may include a detent mechanism that permits a user to choose from many different positions.

It should also be appreciated that other mechanisms for mandible guard adjustment are possible, as this aspect is not limited to the embodiment shown in the figures. The mandible guard adjustment system may use a linkage mechanism, a gearing mechanism, a motorized mechanism, a different ratchet and pawl mechanism, or any other suitable arrangement, as this aspect is not so limited. In one embodiment, the mandible guard adjustment mechanism holds the mandible guard in different positions relative to the helmet, but actuation of a release mechanism is not required to move the mandible guard between the different positions. The user may simply apply a force directly to the mandible guard itself to move the mandible guard between positions. For example, in some embodiments, the mandible guard adjustment mechanism may include a detent mechanism.

Figure 7C:
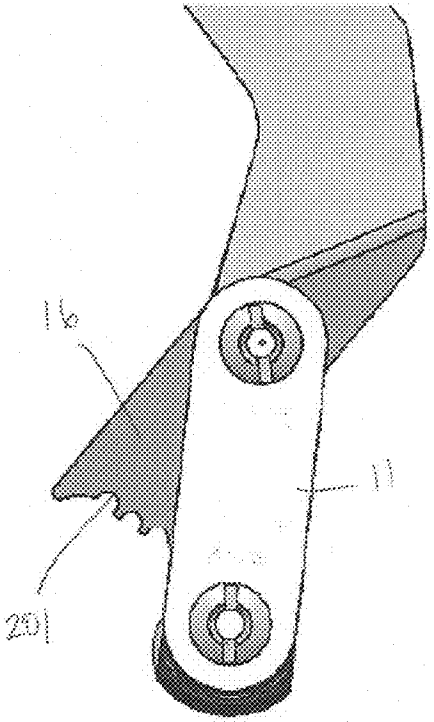
FIG. 7C is a cutaway view of the mandible guard adjustment system of FIG. 7A where the mandible guard is in the fully lowered position.
Figure 7B:
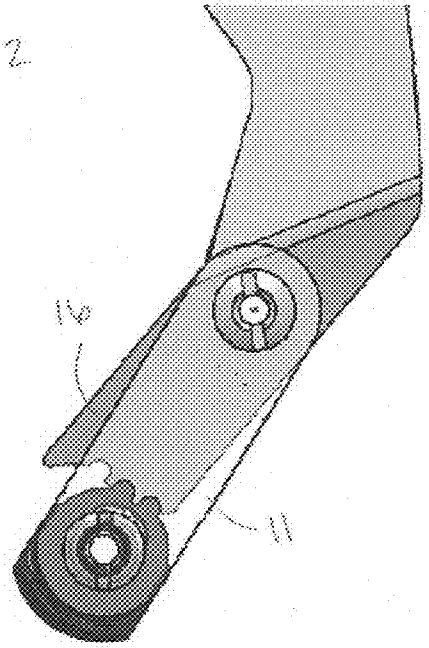
FIG. 7B depicts a cutaway view of the mandible guard adjustment system of FIG. 7A where the mandible guard is in the intermediate position.
Figure 7A:
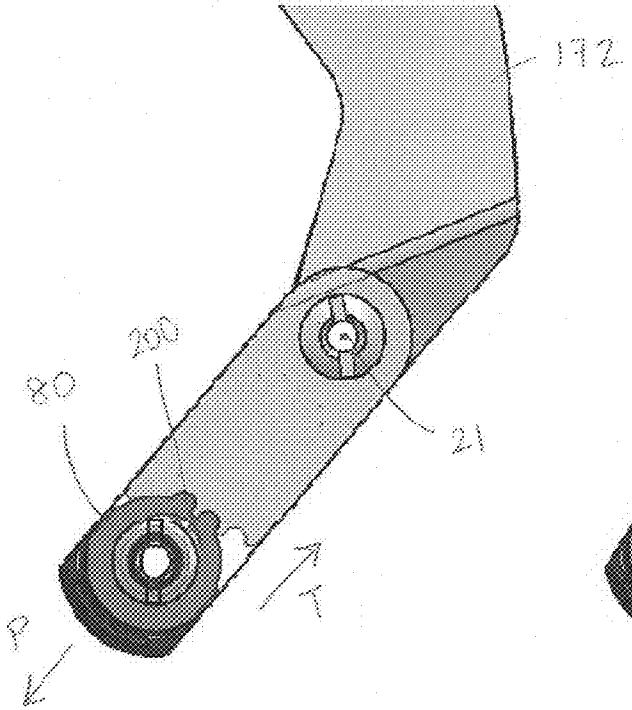
FIG. 7A is a cutaway view of another embodiment of a mandible guard adjustment system where the mandible guard is in the fully raised position.
Figure 8B:
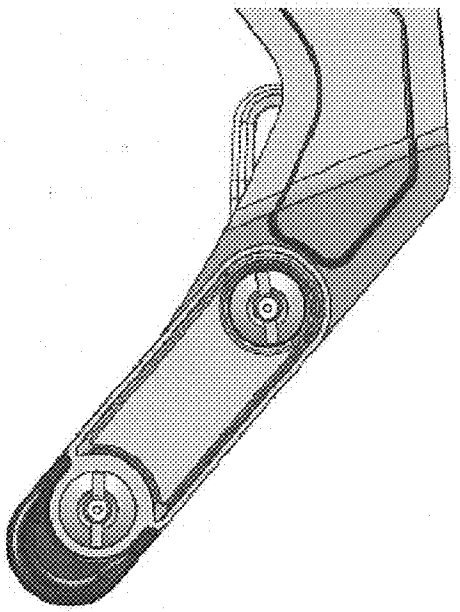
FIG. 8B is a perspective view of the mandible guard adjustment system of FIG. 7A.
Figure 8A:
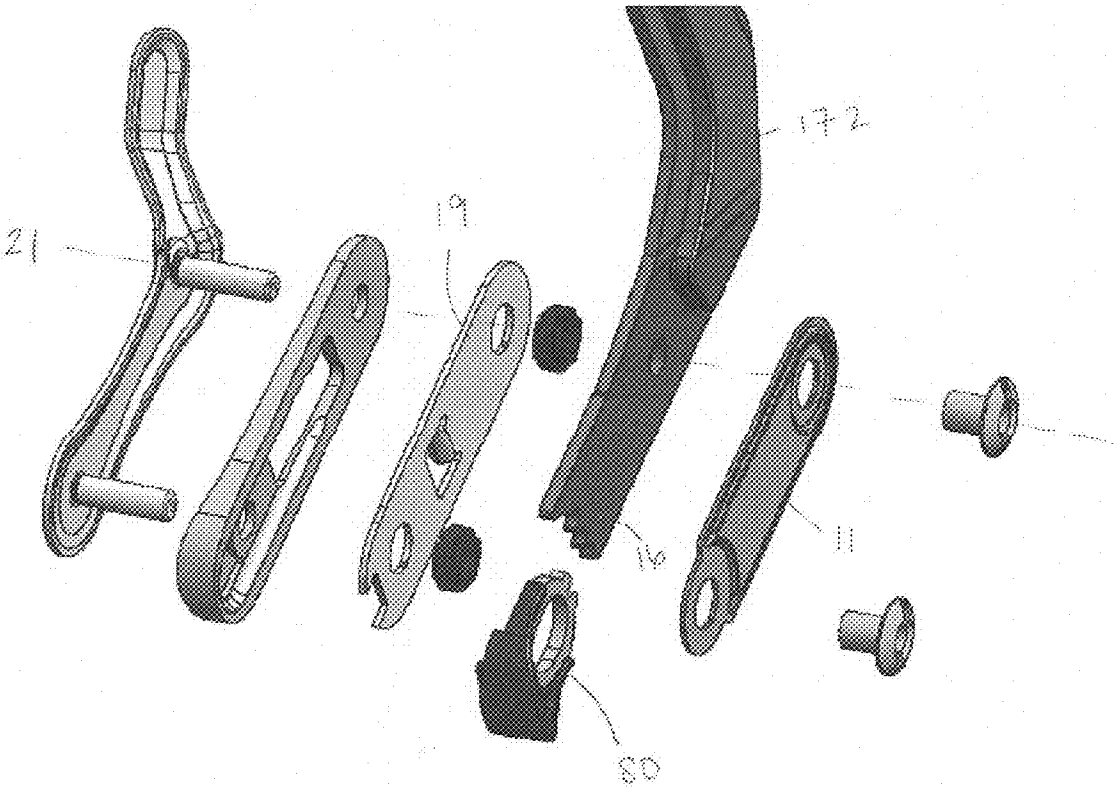
FIG. 8A is an exploded view of the mandible guard adjustment system of FIG. 7A.

In one alternative embodiment shown in FIGS. 7-8, position control 80 includes one or more protrusions 200 that fit within indentations 201 at the end 16 of the attachment arm 172. The position control 80 is biased toward the end 16 of the attachment arm 172 in direction T by a biasing element (not shown) such that the protrusions 200 on the position control are biased to remain within the indentations 201. Interaction of the protrusions 200 with the indentations 201 holds the mandible guard at various positions relative to the helmet. It should be appreciated that the protrusions and indentations may be reversed such that the protrusions are located on the attachment arm 172 and the indentations are located on the position control 80, as this aspect is not limited in this regard.

In FIG. 7A, the position control is arranged to hold the mandible guard at a fully raised position. In FIG. 7B, the position control is arranged to hold the mandible guard at an intermediate position. In FIG. 7C, the position control is arranged to hold the mandible guard at a fully lowered position. In some cases, the interaction of the protrusions 200 with the indentations 201 fully secures the mandible guard at each of its various positions such that the mandible guard cannot be moved in the upward or downward directions unless a release mechanism is actuated. In one embodiment, releasing the mandible guard comprises pulling the position control 80 away from the end 16 of the attachment arm 172 in direction P, against the biasing force that urges the two components toward one another. Pulling the position control 80 away from the end 16 of the attachment arm 172 removes the protrusions 200 of the position control from the indentations 201 of the attachment arm end 16. The position control 80 and plates 11, 19 are thus free to revolve around axis 21 relative to attachment arm 172. As a result, the mandible guard, which is fixed to plates 11, 19, is free to pivot about axis 21, thereby permitting adjustment of the mandible guard relative to attachment arm 172 and the helmet.

In still further embodiments, the position control may not be biased into a locking position, but instead remain unlocked until the user pushes or otherwise moves the position control back into a locking position.

In other embodiments, the mandible guard adjustment system may be configured such that the mandible guard moves in pure translation relative to the helmet. In some embodiments, the position control may comprise a slot or other track on the attachment arm along which the mandible guard may slide to change the distance between point X on the front brim of the helmet and point Z on the mandible guard. It should be appreciated that components may be reversed such that the position control comprises a slot or other track on the mandible guard. The position control may include detents or other ratcheting mechanisms to hold the mandible guard at various discrete positions. In some embodiments, the mandible guard may be adjusted into different positions relative to the helmet without changing the pitch angle of the mandible guard relative to the helmet. For example, looking at FIG. 2A, the position control may permit the mandible guard to slide in a direction along line YZ, in which case the pitch angle $\theta_1$ would not change as the mandible guard is moved relative to the helmet. The mandible guard adjustment system may hold the mandible guard at a continuous spectrum of translational positions or at discrete translational positions that are spaced apart from one another.

According to another aspect, the mandible guard permits hands-free angle adjustment in which the mandible guard can be moved from a lowered, stand-by open position to a raised, ready position without requiring the user to move the mandible guard by hand. Applicants have appreciated that in situations where the user's hands are full, such as when carrying objects like a weapon or flashlight, or when operating a vehicle, the user may not have a free hand to move the mandible guard from a lowered position to a raised position. A hands-free mandible guard adjustment capability enables the user to quickly place the mandible guard in the raised position without needing to first free up the user's hands.

In some embodiments, the mandible guard adjustment system secures the mandible guard against downward movement. The mandible guard is prevented from movement in the downward direction unless a release mechanism or other release element is actuated. The mandible guard is prevented from rotating downwardly unless a release mechanism is actuated, but free to move upwardly simply by pushing upwardly on the mandible guard. In one illustrative example of a hands-free adjustment of the mandible guard upward toward the helmet, the user may tilt his or head forward while wearing the helmet such that the bottom end of the mandible guard contacts the user's chest. Abutment of the mandible guard with the user's chest applies a force to the mandible guard that rotates the mandible guard upwardly toward the fully raised position.

FIGS. 4A-4E illustrate one embodiment of such an arrangement. As previously discussed, the protrusion 89 at the pawl 84 of the position control 80 has a steeply sloped surface 88 and a more gently sloped surface 86. Referring to FIG. 4C, as the mandible guard 20 rotates upwardly due to a force applied to the mandible guard 20, the position control 80 revolves clockwise with the mandible guard around axis 21 (see FIG. 3A) until the surface 86 of the position control 80 contacts tooth 17 of the attachment arm 172. Because surface 86 is gently sloped, as the surface 86 slides against the teeth 13, 17, the position control 80 pivots slightly in the clockwise direction about axis 81 to allow the protrusion 89 to slide past the teeth 13, 17. As a result, the position control 80 can slide past the teeth 17, 13 of end 16 as the mandible guard 20 and position control 80 are moved upward toward the intermediate position or the fully raised position. Once in the intermediate or the fully raised position, however, the position control 80 is locked from rotating back down toward the lowered position because the more steeply sloped surface 88 of the position control 80 cannot slide past the teeth 13, 17. As discussed in a previous section, actuation of the position control 80 is required to unlock the mandible guard 20 from the fully raised position down toward the intermediate position, or from the intermediate position down toward the fully lowered position.

It should be appreciated that other arrangements are possible, as this aspect is not so limited. For example, the mandible guard adjustment system may include any suitable one-way ratcheting system that allows rotation of the mandible guard in the upward direction but not the downward direction. The one-way ratcheting system may include a release button or other actuator to permit downward rotation of the mandible guard. As another example, the mandible guard adjustment system may include a motor or other suitable electronic system that rotates the mandible guard upwards upon actuation or signaling by a user or due to an automatic detection system that senses triggering conditions such as the detection of nearby enemy units.

It should also be appreciated that the mandible guard adjustment system may fully secure the mandible guard in one or more positions such that the mandible guard is prevented from movement in upward and downward directions unless a release mechanism or other release element is actuated. For a hands-free arrangement, the release mechanism or other release element may be actuated by a part of the body other than the hands (e.g., contact of the mandible guard with the chest when the user tilts his head downward actuates a release mechanism), by an oral command, by an automated sensing system that detects triggering conditions such as nearby enemy units, or by other suitable actuation arrangements.

In another embodiment, the mandible guard adjustment system permits the mandible guard to be adjusted to different positions without requiring direct contact with a release mechanism. A user may adjust the position of the mandible guard relative to the helmet simply by manipulating the mandible guard itself. For example, in some embodiments, the mandible guard adjustment system may include a position control in the form of a detent or other mechanism. The resistance of the detent holds the mandible guard in its position relative to the helmet. Applying a force to the mandible guard in a certain direction, e.g., in a forward direction away from the helmet, overcomes the resistance of the detent and permits the mandible guard to move to a different position.

According to another aspect, the mandible guard may be adjustable to permit increased ventilation, hydration and/or consumption of food. A mandible guard can obstruct a user's access to liquids or food, especially when used in conjunction with a face shield. Additionally, ventilation may be limited in many arrangements. Applicants have appreciated that a user may wish to ventilate the helmet and/or hydrate or consume food without needing to completely remove the helmet and/or mandible guard. Increased ventilation and access to the user's face for hydration or food may be provided by allowing the mandible guard to be adjustable relative to the helmet while the helmet is being worn.

Figure 9:
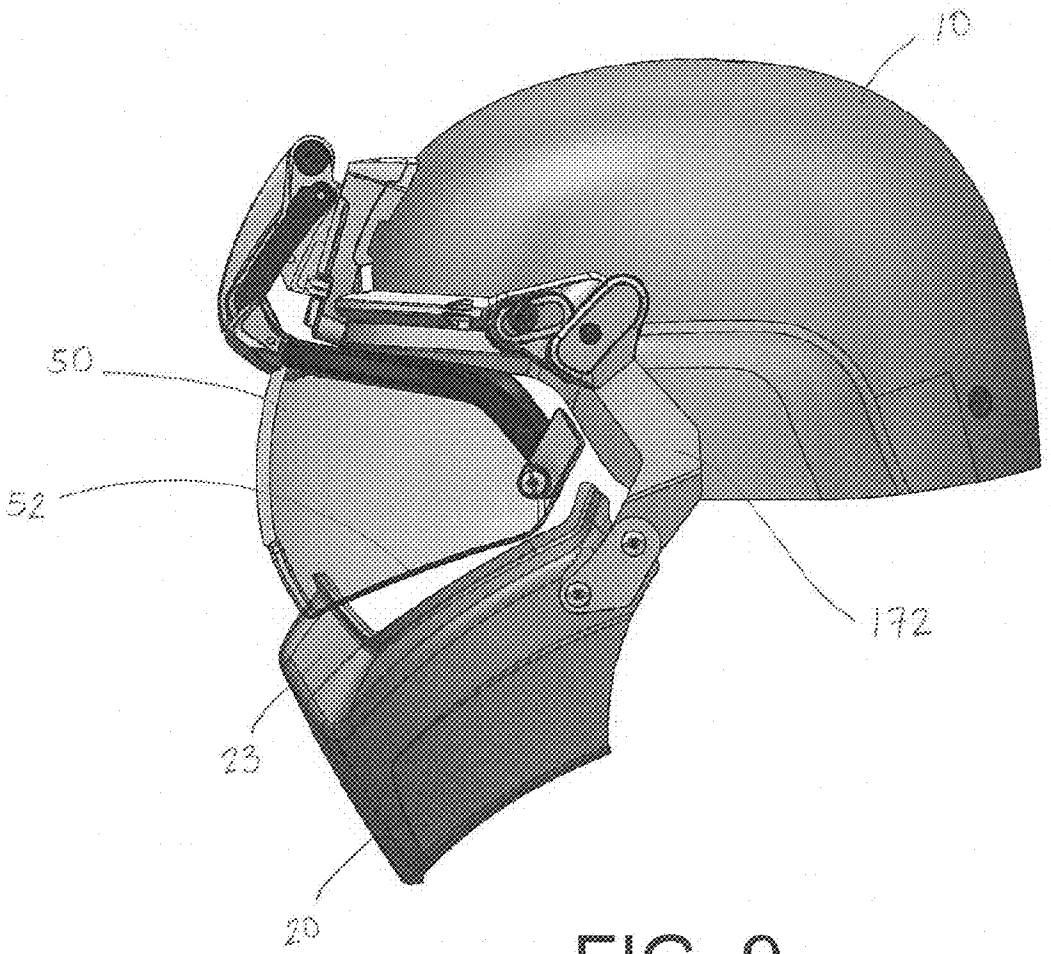
FIG. 9 depicts the helmet assembly of FIG. 1 where the visor and mandible guard are positioned to permit increased ventilation, hydration and/or consumption of food.

Turning to the figures, as shown in FIG. 9, the visor 50 is in a slightly raised position above the lowered, use position and the mandible guard 20 is adjusted into the intermediate position, thereby providing a gap between the bottom edge 52 of the visor 50 and the top surface 23 of the mandible guard. This gap provides increased airflow to the user's face and head, and may allow the user to hydrate and/or consume food. It should be appreciated that the mandible guard may also be lowered to the fully lowered position for ventilation, hydration, and/or food consumption. It should also be appreciated that a gap between the bottom of the visor and the top surface of the mandible guard may be formed when the visor is in the lowered use position and the mandible guard is in the intermediate position.

In addition, when the helmet is in the completely sealed state, it may be difficult for the user to communicate orally with others. The user may move the mandible guard to the intermediate or fully lowered position in order to better communicate.

In some cases, a user may interact with one or more devices that require close proximity to the user's face. Illustrative examples of such devices include, but are not limited to, optical devices, cameras, weapon sights, a monocular or a pair of binoculars, helmet-mounted display units, headlamps and communication devices such as a mobile phone or other portable transceiver. Such devices may be positioned at the front of the helmet. Some of these devices may be helmet-mounted devices that are mounted to the via a mount such as the central accessory mount 55 as shown in FIG. 1, while others may be handheld or otherwise positioned in front of the user. In some cases, such devices may be incompatible with the use of a mandible guard because the devices may extend into the space occupied by the mandible guard. In such scenarios, the user may have to remove the mandible guard altogether before the device can be used, making the process time inefficient and leaving the user's jaw exposed.

According to one aspect, the position of the mandible guard may be adjusted to permit compatibility with such devices. In such arrangements, the mandible guard may continue to afford a level of protection to the user while a device is used. In some cases, the position of the mandible guard may be adjusted to permit access to specific portions of a device such as weapon sights.

Figure 10:
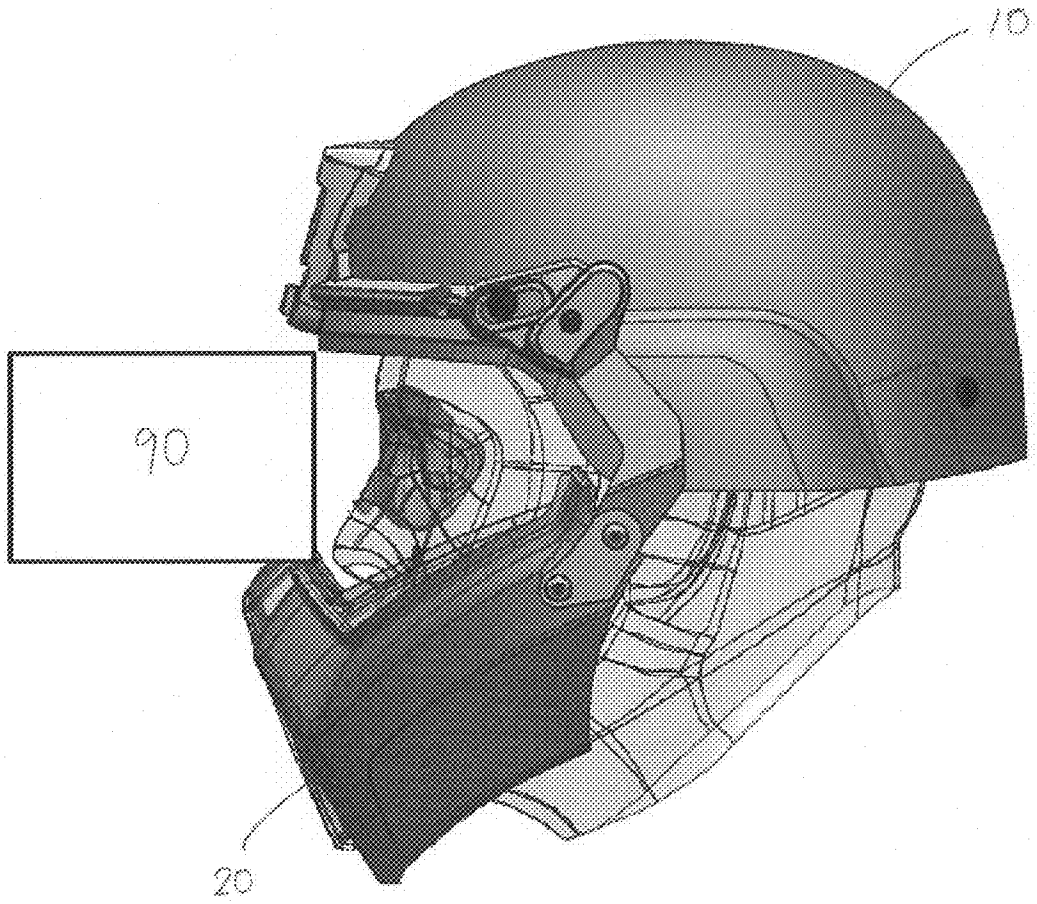
FIG. 10 depicts the helmet assembly of FIG. 1 with the mandible guard in the intermediate position for compatibility with a device.

In some embodiments, such as the embodiment shown in FIG. 10, the mandible guard 20 may be lowered to an intermediate position to accommodate the device 90. When the device 90 is moved out of the way or replaced with a smaller device, the user may adjust the mandible guard 20 up to the fully raised position. In some embodiments, the mandible guard may have many different positions to allow a user to fine-tune the angle of the mandible guard in order to accommodate various devices of different sizes.

In some cases, both a protective face shield and a mandible guard may be attached to a helmet, such as in the embodiment shown in FIG. 9. In some helmet arrangements where the mandible guard is lifted upwardly toward the front brim of the helmet to detach the mandible guard from the helmet, the face shield has to be removed from the helmet before the mandible guard can be detached. Even when the face shield is moved to its highest point to a stand-by, non-use position, in some circumstances, the mandible guard may still collide with the face shield during an attempted removal of the mandible guard, making it impossible or extremely difficult to remove the mandible guard while the face shield is still attached to the helmet. As a result, users of such systems detach the face shield from the helmet before the mandible guard can be removed.

According to one aspect of the present disclosure, the mandible guard may be detached from the helmet without requiring removal of the face shield, thereby improving the removability of the mandible guard.

In one embodiment, the user removes the mandible guard by first moving the protective face shield up from a lowered use position to a stand-by, non-use position away from the helmet. Second, the user moves the mandible guard down to an intermediate or lowered position by actuating a mandible guard adjustment system as discussed herein. Lastly, the user disconnects the mandible guard from the helmet by actuating a mandible guard attachment system as described below. In another embodiment, the user may remove the mandible guard without needing to first move the protective face shield to a raised stand-by, non-use position. The user may simply move the mandible guard down to an intermediate or lowered position and then disconnect the mandible guard from the helmet by actuating a mandible guard attachment system while the face shield remains in a lowered, use position.

It should be appreciated that the mandible guard may be attached to the helmet using any suitable attachment arrangement, as this aspect is not so limited. In some embodiments, the helmet assembly may attach the mandible guard to the helmet using the helmet accessory attachment system as described in U.S. patent application Ser. No. 13/563,584, which is herein incorporated by reference to the extent not inconsistent with the present description.

One embodiment of a mandible guard attachment system is shown in FIGS. 1, 3A, and 9-12. As shown in FIG. 1, the mandible guard attachment system includes a helmet rail 100 that selectively attaches with the a left attachment arm 172 and a right attachment arm (not shown). The helmet rail 100 extends across at least a partial width of the helmet and is positioned over a face opening of the helmet 10 between right and left ear cups 39, and in some embodiments, over a portion of the ear cup area. The attachment portion 174 (see FIG. 3A) attaches the attachment arm 172 to the helmet rail 100.

Figure 11B:
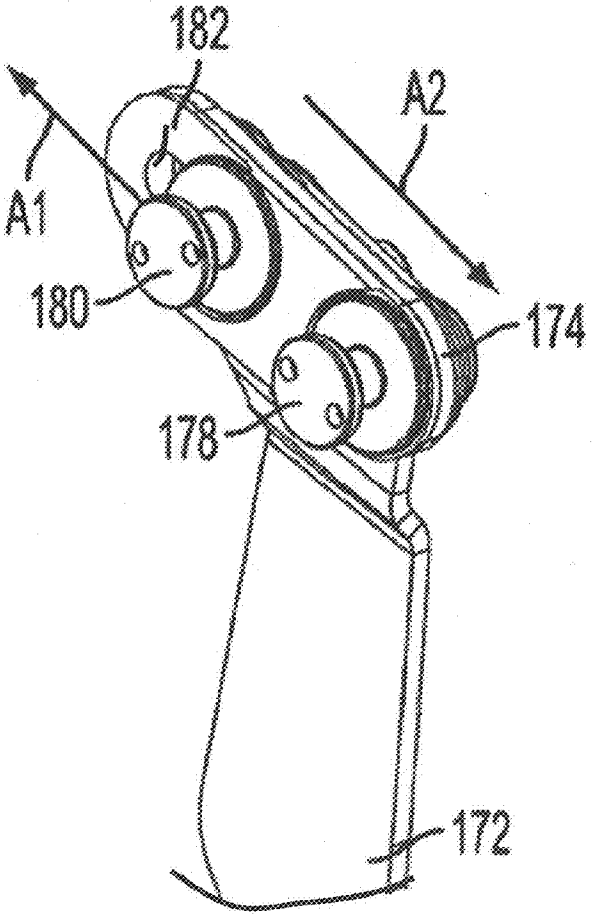
FIG. 11B is an interior perspective view of an attachment portion of an attachment arm.
Figure 11A:
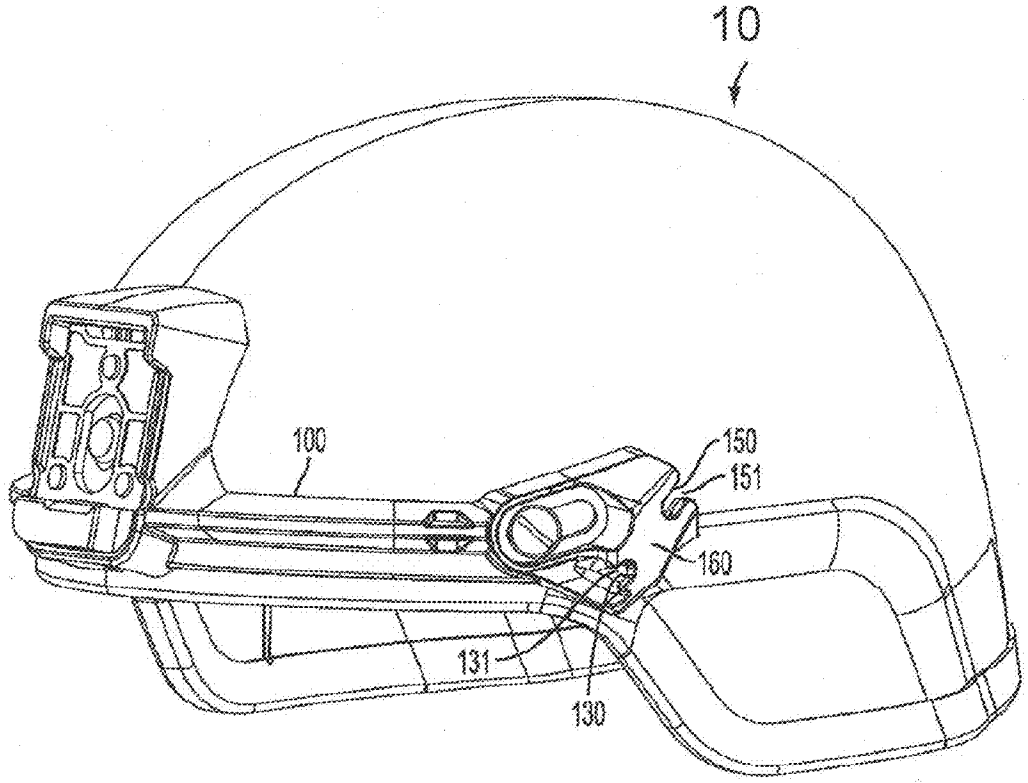
FIG. 11A is a perspective view of a helmet and attached mounting portion.

FIGS. 11A and 11B depict a helmet incorporating the above noted helmet rail 100 and an associated attachment portion 174 of an attachment arm 172 in a detached state. The attachment arm 172 includes an attachment portion 174 and an accessory retention portion 176 (see FIGS. 3A and 4A). The attachment portion 174 is configured to be selectively attachable to a mounting portion 160 associated with helmet rail 100. While mounting portion 160 is depicted as being operatively coupled with helmet rail 100, the mounting portion could be integrally formed with or directly attached to helmet 10. The mounting portion 160 includes a position channel 130 and support channel 150. The attachment portion 174 includes corresponding position member 178 and a movable member embodied as slide member 180. The slide member 180 and position member 178 are configured to slide in the channels on the mounting portion while being retained therein. As depicted in the figures, slide member 180 and position member 178 may be pins with retention features configured to retain the members within the corresponding channels. Alternatively, in some embodiments, position member 178 may be a boss, protrusion, or any other suitable construction that may be slidingly retained in the corresponding channel. As described in more detail below, the attachment portion and mounting portion are configured to be selectively attachable to one another by the selective positioning of slide member 180 in support channel 150 and position member 178 in position channel 130.

While specific embodiments of the slide member 180 and position number 178 are depicted herein, any suitable arrangement capable of retaining the slide member 180 and position member 178 within the corresponding channels while permitting the desired selective attachment is contemplated as being part of the present disclosure.

In the depicted embodiment, the position member 178 is fixedly attached to the attachment portion 174 such that it is stationary relative to the attachment portion during operation. On the other hand, the slide member 180 is slidingly retained within a slot 182 on the attachment portion such that it is selectively movable in a direction A1 between a home position and a release position. In certain embodiments, slide member 180 is held stationary relative to the mounting portion on the helmet during attachment of the attachment and mounting portions. In such embodiments, the attachment portion itself is displaced relative to the mounting portion in a direction corresponding to direction A2 depicted in FIG. 11B. However, regardless of which component is held stationary it is the slide member that is selectively moveable between the home and release position. In the depicted embodiment, the slide member 180 is positioned closer to the position member when in the home position and further from the position member when in the release position. The slide member 180 is biased toward the home position by an applied biasing force directed toward the home position provided by a biasing element such as a spring or other suitable construction. While the presently disclosed embodiments depict a release position that is further away from the position member than the home position, embodiments in which the slide member 180 is located closer to the position member 178 in the release position than in the home position are also envisioned.

As depicted in FIG. 11A, the support channel 150 includes a first opening 151 and the position channel 130 includes a second opening 131. In the current embodiment, the distance between the first opening 151 and second opening 131 is greater than the distance between the slide member 180 and position member 178 when the slide member 180 is in the home position. Additionally, the distance between the first opening 151 and second opening 131 is less than the distance between the slide member 180 and position member 178 when the slide member 180 is in the release position. Therefore, when aligned with the corresponding channels, the slide member 180 and position member 178 may be selectively retained in the corresponding support channel 150 and position channel 130 when the slide member 180 is in the home position, and may be selectively released when the slide member 180 is in the release position.

Referring to FIGS. 11A and 11B, an exemplary procedure for attaching the attachment portion 174 to the mounting portion 160 is described. Slide member 180 is inserted into opening 151 and received in support channel 150. When positioned at the end of the channel, with the slide member 180 in the home position, the position member 178 is unable to enter opening 131 due to the distance between the position member 178 and slide member 180 being too short. Subsequently, slide member 180 is biased into the release position as the attachment portion 174 is moved in a direction A2 substantially toward the position channel 130. Once slide member 180 is biased into the release position, the distance between the slide member 180 and position member 178 is greater than the distance between openings 151 and 131. Subsequently, the attachment portion 174 may be pivoted about slide member 180 such that position member 178 is rotated into alignment with opening 131 of position channel 130. During attachment of the mandible guard to the helmet, the mandible guard is pivoted downwardly relative to the helmet. After placing the position member into alignment with the opening, the attachment portion is permitted to move in the reverse direction toward support channel 150 due to the biasing of slide member 180 toward the home position. This leads to a reduction in the distance between slide member 180 and position member 178 such that they are retained within support channel 150 and position channel 130 respectively. It is the selective retention of the slide member 180 and position member 178 within the associated channels that provides the selective attachment of the attachment portion 174 and mounting portion 160. To remove the attachment portion 174 from the mounting portion 160, the user first adjusts the mandible guard to an intermediate or fully lowered position, and then the above-described process for attaching the attachment portion 174 to the mounting portion 160 is reversed. During removal of the mandible guard, the mandible guard is pivoted upward relative to the helmet. With the mandible guard lowered to an intermediate or full lowered position, the mandible guard does not collide or otherwise interfere with the visor when the mandible guard is pivoted upward relative to the helmet during removal of the mandible guard.

Figure 11C:
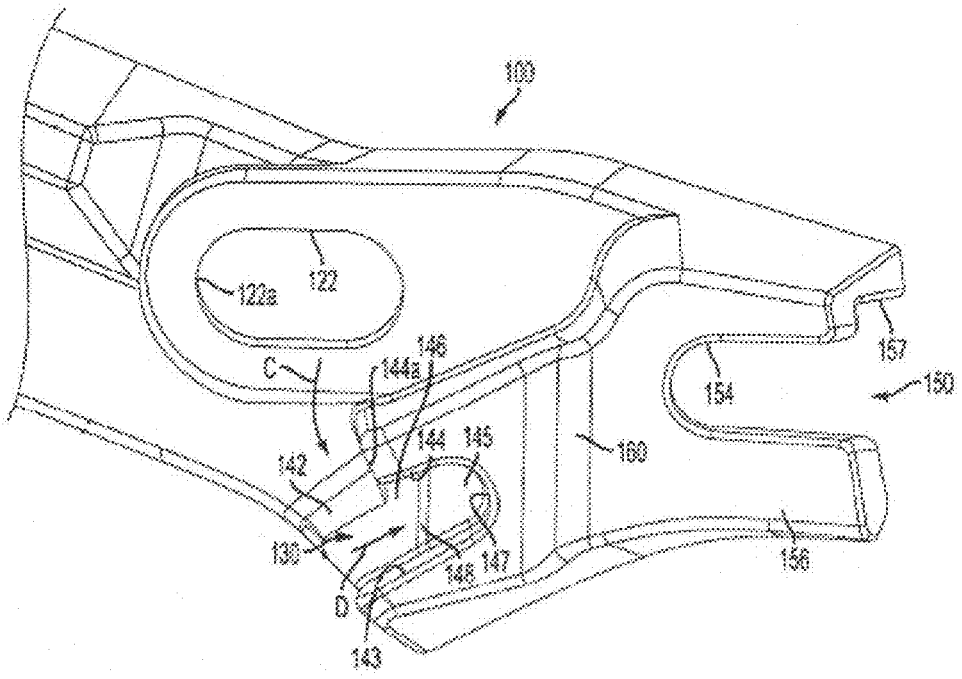
FIG. 11C is an exterior side view of the mounting portion shown in FIG. 11A.
Figure 11D:
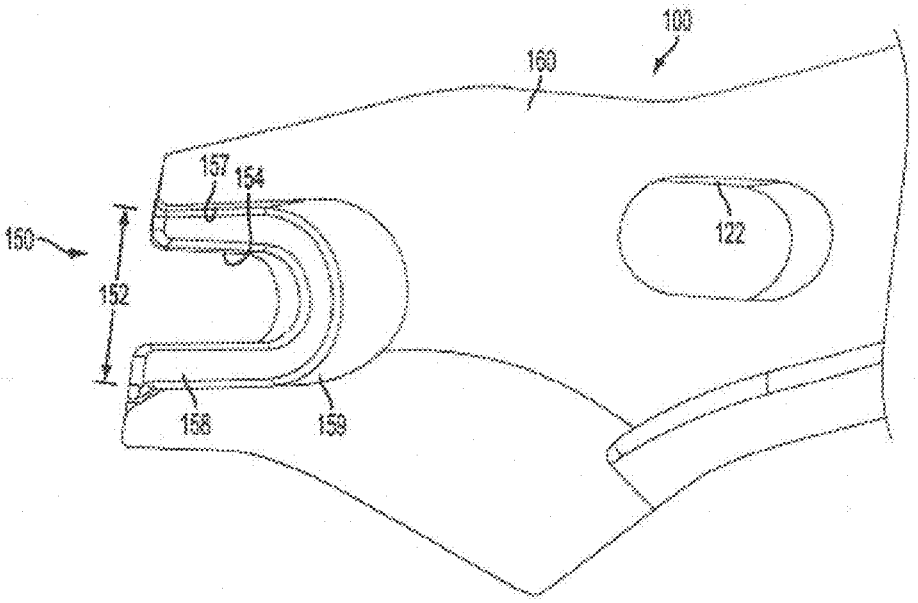
FIG. 11D is an interior side view of the mounting portion shown in FIG. 11A.

Turning now to a more detailed description of the mounting portion, FIGS. 11C and 11D show an enlarged perspective view of one particular embodiment of an end region of helmet rail 100 corresponding to mounting portion 160 of the helmet accessory attachment system. Support channels 150 (right side not shown) are provided on mounting portions 160 at opposite ends of the helmet rail 100 adjacent to the mounting slots 122. The two separate support channels 150 comprise a front surface 156 having a U-shaped slot 154. Behind the front surface 156 is a first rearward extending wall 157, and a second opposite rearward extending wall 159 forming a receiving channel 152 with a shelf 158. The receiving channel and shelf retain the sliding member while permitting the sliding member to slide therein.

In the depicted embodiment, position channels 130 are provided between the support channel and the inner most edge 122*a* of the mounting slot opening on each lateral side of the helmet rail 100. The position channel 130 has a lower wall 143, an opposite upper wall 144 creating a u-shaped formation 147. The floor of the position channel 130 has a first outer floor portion 146 and an inner floor portion 145 adjacent the base of the u-shaped formation 147. The first outer floor portion is recessed to a position behind the inner floor portion with a transition 148 connecting the outer floor portion to the inner floor portion. The length of the lower wall 143 is longer than the upper wall 144. A sloping downward portion 142 joins with the outer floor portion 146 in an area opposite the lower wall 143 where the upper wall 144 does not extend. The shortened upper wall allows the position boss 215 to rotate upwards moving forward out of the u-shaped formation sufficient to clear the upper wall 144. Similar to support channels 150, position channels 130 include a receiving channel and corresponding shelf, not depicted, to retain the position member while permitting it to slide therein.

While the support channels and corresponding position channels have been depicted as being oriented at approximately a 45° angle relative to each other, other orientations are also possible. For example, the channels could be oriented substantially parallel, at approximately 90°, or any other suitable orientation and configuration that would permit the slide member and position member to be selectively retained therein.

When it is desired to attach the mandible guard to the helmet, slide members 180 present on the attachment portion of each attachment arm are substantially simultaneously slid into the corresponding support channels 150 with the position members 178 positioned above the position channels 130. The mandible guard is then drawn forward, which causes the attachment portion 174 to move forward in the direction A2 relative to the slide members 180, which are held stationary at the back of the support channels 150. The attachment portions 174 are drawn fully forward so that the slide members 180 are in the release position. In the release position, the position members 178 are sufficiently forward of the forward end of the upper wall 144 of the position channel 130 to allow the position members 178 to be lowered, in the direction C as shown in FIG. 11C, into alignment with the position channel 130. The portion of the lower wall 143 that extends beyond the upper wall 144 provides a floor below which the position member does not travel and will guide the position member into the position channel. Once the upper most portion of the position members 178 are positioned below the upper wall 144, the biasing force applied to the slide members is permitted to draw the position members 178 in the direction D shown in FIG. 11C. The position member is drawn inwardly until the position member is adjacent to or against the back of the position channel and/or until the slide member reaches the home position. Once the position members 178 are seated within the position channels, the attachment arms 172 and the mandible guard are held in place. In some instances, additional support may be provided by components that interact with a bottom edge of the helmet when the slide members and position members are retained in the corresponding channels.

To remove the mandible guard, the mounting procedure is reversed. The mandible guard and attachment arm 172 are pulled forward to draw the position members 178 clear of the upper wall 144 of the position channel by overcoming the biasing force of the biasing element. The mandible guard and attachment arm 172 are then pivoted upward causing the position members to correspondingly move upward in a direction opposite that of direction C shown in FIG. 11C along front wall 144*a*. Once the position members clear the top of the front wall 144*a*, the mandible guard and attachment arms can be drawn rearward to remove slide members 180 from support channels 150, thus detaching the attachment portions from the corresponding mounting portions on the helmet.

Figure 12B:
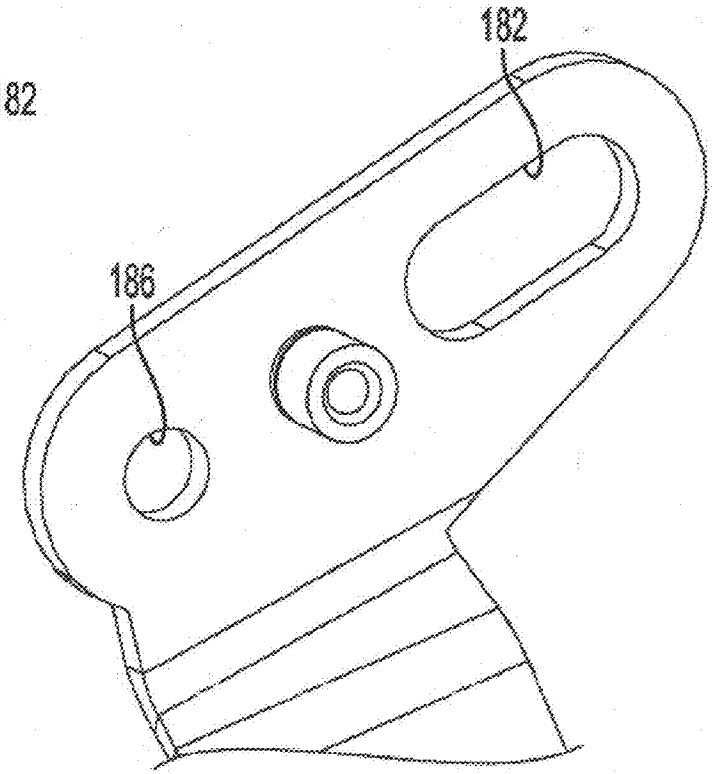
FIG. 12B is a perspective view of an attachment arm of the attachment portion shown in FIG. 11B.
Figure 12A:
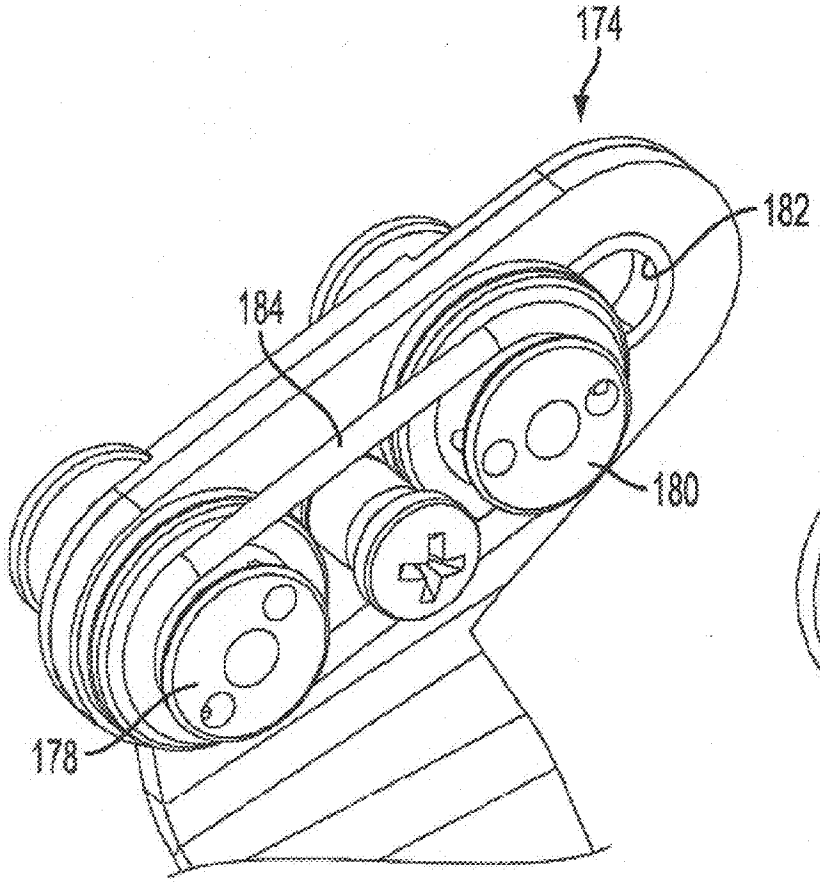
FIG. 12A is an exterior perspective of the attachment portion shown in FIG. 11B.

FIGS. 12A-12B present one embodiment of the attachment portion. In the depicted embodiment, an attachment portion 174 includes a slide member 180 slidingly received in slot 182 and a position member 178 attached at through hole 186. While an oblong oval shape for the slot has been depicted, any suitable shape could be used to provide the desired sliding motion including, for example, arcs, rectangles, and any other suitable shape. Accordingly, the associated slide member may be linearly movable or nonlinearly movable. It should be noted, that position member 178 is stationary relative to the attachment portion 174. Furthermore, the position member 178 may be attached to the attachment portion using any suitable means including, but not limited to, the depicted through hole, a threaded connection, a bolted connection, and other suitable methods. Alternatively, in some instances, the position member may be a boss, or similar feature, that is integrally formed with, or attached to, the attachment portion.

In addition to including a slide member and position member, the attachment portion 174 also includes a biasing element 184 for applying a biasing force to the slide member. In the current embodiment, the biasing element includes a resilient ring, such as an O-ring that is attached to both the slide member 180 and position member 178. When the slide member is drawn outwards toward the release position the resilient ring is deformed resulting in a biasing force being applied to both the slide member 180 and position member 178. Since the position member is fixed relative to the attachment portion, the slide member 180 is drawn toward the position member and the corresponding home position. While the resilient ring has been depicted as being attached to both the position member and slide member, it should be understood that the resilient ring could have been attached to the slide member and another suitable feature to provide the desired biasing force upon movement of the slide member toward the release position. Depending on the orientation of the corresponding channels on the mounting portion, in some embodiments, the home position may be located further away, or in a different orientation, from the position member than depicted in the figures. In such an embodiment, the biasing element would be constructed and arranged to bias the slide member away from the position member.

The above described components may be made with various materials, as the invention is not necessarily so limited. The helmet and mandible guard, may for example, be constructed from materials such as an ultra-high molecular weight polyethylene known as Dyneema®, which may be obtained from DSM Dyneema LLC, a synthetic fiber known as KEVLAR®, which may be obtained from DuPont, carbon fibers and other materials designed to withstand various ballistic, compression and deformation testing, such that the mandible guard and helmet are suitable for various military applications. The position control and/or attachment arm may be made from stainless steel, titanium, aluminum or other suitable material or combination of materials.

The above aspects may be employed in any suitable combination, as the present invention is not limited in this respect. While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An apparatus comprising:

a mandible guard for a helmet; and a position control that holds the mandible guard in a first position relative to the helmet and a second position relative to the helmet;

wherein the first position defines a first distance from a point on the helmet to a point on the mandible guard and the second position defines a second distance from the point on the helmet to the point on the mandible guard, the second distance being different from the first distance, the point on the helmet being a laterally centered point on a front brim of the helmet, and the point on the mandible guard being a laterally centered point on the mandible guard;

wherein the position control permits adjustment of the mandible guard from the first position to the second position by a user while the helmet is worn by the user;

wherein in the first and second positions, the mandible guard is below the front brim of the helmet;

wherein the position control includes a release mechanism, and the position control secures the mandible guard in the first position such that the mandible guard is able to move from the first position to the second position only by actuating the release mechanism; and wherein the mandible guard is movable from the second position to the first position by applying a force to the mandible guard without actuating the release mechanism.

2. The apparatus of claim 1, wherein the first position has a first pitch angle between the helmet and the mandible guard and the second position has a second pitch angle between the helmet and the mandible guard, the second pitch angle being different from the first pitch angle.

3. The apparatus of claim 2, wherein each of the first and second pitch angles are discrete angles spaced from one another and set by the arrangement of the position control.

4. The apparatus of claim 2, wherein the second pitch angle is greater than the first pitch angle.

5. The apparatus of claim 4, wherein the position control holds the mandible guard at a third position relative to the helmet, the third position having a third pitch angle between the helmet and the mandible guard, the third pitch angle being greater than the second pitch angle.

6. The apparatus of claim 5, wherein the third pitch angle is at least 25 degrees greater than the first pitch angle.

7. The apparatus of claim 5, wherein the position control fully secures the mandible guard in the second position by preventing movement of the mandible guard from the second position to either of the first and third positions unless a release is actuated.

8. The apparatus of claim 5, wherein the position control holds the mandible guard in the second position by preventing movement of the mandible guard from the second position to the third position unless a release is actuated, and the position control permits movement of the mandible guard to the first position without actuation of the release.

9. The apparatus of claim 4, further comprising:

the helmet; and a visor attached to the helmet, the visor being movable from a use position to a non-use position, wherein:

when the visor is in the non-use position and the mandible guard is positioned at the second position, the mandible guard is removable from the helmet without the visor interfering with the mandible guard.

10. The apparatus of claim 9, wherein the mandible guard is placed in a removable orientation relative to the helmet by pivoting the mandible guard upwardly relative to the helmet without the visor interfering with the mandible guard.

11. An apparatus as in claim 4, wherein the second pitch angle is at least five degrees greater than the first pitch angle.

12. The apparatus of claim 4, wherein the second pitch angle is at least eight degrees greater than the first pitch angle.

13. The apparatus of claim 4, further comprising the helmet, and further comprising a visor attached to the helmet, wherein when the mandible guard is in the second position, a gap is formed between a bottom edge of the visor and a top surface of the mandible guard.

14. The apparatus of claim 4, further comprising the helmet, and further comprising a helmet-mounted device attached to the helmet, wherein the mandible guard interferes with the helmet-mounted device at the first position but does not interfere with the helmet-mounted device at the second position.

15. The apparatus of claim 1, wherein the mandible guard is movable from the first position to the second position without removing the mandible guard from the helmet.

16. The apparatus of claim 1, wherein the second distance is greater than the first distance.

17. The apparatus of claim 16, wherein the position control holds the mandible guard at a third position relative to the helmet, the third position having a third distance from the point on the front brim of the helmet to the point on the mandible guard, the third distance being greater than the second distance.

18. The apparatus of claim 1, wherein the mandible guard is removably attachable to the helmet.

19. The apparatus of claim 18, wherein the mandible guard can be attached to and removed from the helmet by hand.

20. The apparatus of claim 1, further comprising:

an attachment portion comprising a biasing element, a position member, and a movable member, the movable member being selectively movable between a home position which is at a third distance from the position member and a release position which is at a fourth distance from the position member, wherein the biasing element biases the movable member toward the home position; and a mounting portion attachable to a helmet, wherein the mounting portion comprises a first channel to receive the movable member at a first opening and a second channel to receive the position member at a second opening, wherein a fifth distance between the first opening of the first channel and the second opening of the second channel is greater than the third distance from the movable member to the position member in the home position, wherein the attachment portion is configured to selectively attach to the mandible guard.

21. The apparatus of claim 20, wherein the fifth distance between the first opening of the first channel and the second opening of the second channel is less than the fourth distance from the movable member to the position member in the release position.

22. The apparatus of claim 20, wherein the movable member is a slide member.

23. The apparatus of claim 20, wherein the movable member is linearly movable.

24. The helmet accessory attachment system of claim 20, wherein the mounting portion is selectively attachable to a rail on the helmet.

25. The helmet accessory attachment system of claim 20, wherein the biasing element comprises a resilient ring.

26. The apparatus of claim 1, wherein the position control is pivotable relative to the mandible guard.

27. The apparatus of claim 1, wherein the position control comprises a pawl having a first sloped surface and a second sloped surface, the second sloped surface having a steeper slope than the first sloped surface.

28. The apparatus of claim 1, further comprising a biasing element, wherein actuating the release mechanism comprises moving the release mechanism in an actuating direction, and wherein the biasing element biases the release mechanism away from an actuation direction.

29. The apparatus of claim 1, wherein the position control comprises a pawl and the release mechanism comprises a pawl release mechanism, wherein the mandible guard is movable from the first position to the second position when the pawl release mechanism is actuated.

30. The apparatus of claim 1, further comprising an attachment arm that attaches the mandible guard to the helmet.

31. The apparatus of claim 30, wherein the mandible guard is pivotable relative to the attachment arm.

32. The apparatus of claim 30, wherein the attachment arm includes one or more teeth.

33. The apparatus of claim 32, wherein the position control comprises a pawl and the pawl interacts with the one or more teeth of the attachment arm.

34. The apparatus of claim 1, wherein the entire mandible guard is movable from the first position to the second position.

35. The apparatus of claim 1, wherein the position control is configured to hold the mandible guard in one of only three different discrete positions relative to the helmet, the three different discrete positions being spaced from one another.

36. The apparatus of claim 1, wherein the position control comprises first and second position control mechanisms with the first position control mechanism positioned on a left side of the mandible guard, and the second position control mechanism positioned on a right side of the mandible guard.

37. The apparatus of claim 1, wherein the release mechanism comprises a rotatable pushing surface.

38. An apparatus comprising:

a mandible guard;

an attachment arm configured to attach the mandible guard to a helmet;

a position control that holds the mandible guard in a first position relative to the attachment arm and a second position relative to the attachment arm, the mandible guard being movable relative to the attachment arm, wherein the first position defines a first distance from a point on the helmet to a point on the mandible guard and the second position defines a second distance from the point on the helmet to the point on the mandible guard, the second distance being different from the first distance, the point on the helmet being a laterally centered point on a front brim of the helmet, and the point on the mandible guard being a laterally centered point on the mandible guard, wherein in the first and second positions, the mandible guard is below the front brim of the helmet, wherein the attachment arm includes a first tooth and a second tooth, and wherein the position control comprises a pawl and the pawl interacts with the first tooth to hold the mandible guard in the first position such that the mandible guard is prohibited from rotating downwardly when the mandible guard is in the first position, and the pawl interacts with the second tooth to hold the mandible guard such that the mandible guard is prohibited from rotating downwardly when the mandible guard is in the second position.

39. An apparatus comprising:

a mandible guard for a helmet; and a position control that holds the mandible guard in a first position having a first pitch angle relative to the helmet, a second position having a second pitch angle relative to the helmet, and a third position having a third pitch angle relative to the helmet, the first pitch angle, second pitch angle and third pitch angle being different from one another;

wherein the position control permits adjustment of the mandible guard from the first position to the second position by a user while the helmet is worn by the user;

wherein in the first and second positions, the mandible guard is below the front brim of the helmet; and wherein the position control holds the mandible guard in each of the first, second and third positions such that the position control prohibits the mandible guard from rotating downwardly when the mandible guard is in each of the first, second and third positions.

40. An apparatus comprising:

a mandible guard for a helmet; and a position control that holds the mandible guard in a first position relative to the helmet and a second position relative to the helmet;

wherein the first position defines a first distance from a point on the helmet to a point on the mandible guard and the second position defines a second distance from the point on the helmet to the point on the mandible guard, the second distance being different from the first distance, the point on the helmet being a laterally centered point on a front brim of the helmet, and the point on the mandible guard being a laterally centered point on the mandible guard;

wherein in the first and second positions, the mandible guard is below the front brim of the helmet;

wherein the position control permits adjustment of the mandible guard from the first position to the second position by hand;

wherein the position control includes a release mechanism, and the position control secures the mandible guard in the first position such that the mandible guard is able to move from the first position to the second position only by actuating the release mechanism; and wherein the mandible guard is movable from the second position to the first position by applying a force to the mandible guard without actuating the release mechanism.

41. The apparatus of claim 40, wherein the release mechanism comprises a rotatable pushing surface.

* * * * *